US006305361B1

(12) United States Patent
Takaku et al.

(10) Patent No.: US 6,305,361 B1
(45) Date of Patent: Oct. 23, 2001

(54) EVAPORATIVE SYSTEM AND METHOD OF DIAGNOSING SAME

(75) Inventors: Yutaka Takaku; Toshio Ishii, both of Mito; Kazuya Kawano, Hitachinaka; Nobuo Kurihara, Hitachiota; Hiroshi Kimura, Hitachinaka; Kiyoshi Miura, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/538,273

(22) Filed: Mar. 30, 2000

Related U.S. Application Data

(63) Continuation of application No. 08/784,918, filed on Jan. 16, 1997.

(30) Foreign Application Priority Data

Jan. 25, 1996 (JP) ..... 8-010633

(51) Int. Cl.[7] ..... F02M 33/02
(52) U.S. Cl. ..... 123/520; 123/198 D
(58) Field of Search ..... 123/520, 521, 123/518, 519, 198 D, 516

(56) References Cited

U.S. PATENT DOCUMENTS 5,197,442 * 3/1993 Blumenstock et al. ..... 123/520
5,347,971 * 9/1994 Kobayashi et al. ..... 123/520
5,353,771 10/1994 Blumenstock et al. .
5,383,438 * 1/1995 Blumenstock ..... 123/198 D
5,390,645 * 2/1995 Cook et al. ..... 123/520
5,398,661 * 3/1995 Denz et al. ..... 123/520
5,447,141 * 9/1995 Kitamoto et al. ..... 123/520
5,553,577 * 9/1996 Denz et al. ..... 123/198 D

FOREIGN PATENT DOCUMENTS 3-249366 11/1991 (JP) .
6-10779 1/1994 (JP) .
6-249095 9/1994 (JP) .

* cited by examiner

*Primary Examiner*—Carl S. Miller
(74) *Attorney, Agent, or Firm*—Crowell & Moring LLP

(57) ABSTRACT

There is disclosed a leakage diagnosis of an evaporative system in an internal combustion engine, and more particularly there is disclosed an evaporative system in which a more accurate leakage diagnosis can be effected using a change in the pressure in the evaporative system, and such a diagnosis method is also disclosed. The evaporative system includes a gauge line having a gauge valve, which gauge line branches off from an evaporative gas line or an evaporative gas purge line, and communicates with a point upstream of an engine throttle valve or with the ambient atmosphere, a pressure sensor for detecting the pressure in the evaporative system, and a purge valve. A leakage diagnosis of this system is effected based on detected values of the pressure sensor obtained by opening and closing the purge valve and the gauge valve. Therefore, accurate results of the diagnosis can be obtained.

12 Claims, 25 Drawing Sheets

EVAPORATIVE SYSTEM AND METHOD OF DIAGNOSING SAME

This application is a continuation of application Ser. No. 08/784,918, filed Jan. 16, 1997.

BACKGROUND OF THE INVENTION

1. Field of the Invention

This invention relates to an evaporative system in which evaporated fuel (hereinafter referred to as "evaporative gas"), produced in a fuel tank of an internal combustion engine, is temporarily adsorbed in a canister, and the evaporative gas thus adsorbed is discharged to an intake system, and more particularly to an evaporative system enabling a precise detection of a leakage in the evaporative system, and the invention also relates to a method of diagnosing the evaporative system.

2. Description of the Related Art

A so-called evaporative system is provided in order to prevent evaporative gas, produced in a fuel tank, from being discharged to the atmosphere. In this system, the evaporative gas is temporarily adsorbed by an adsorbent in a canister, and the thus adsorbed evaporative gas, together with fresh air drawn from an atmosphere port (drain) in the canister in accordance with an operating condition of an engine, is discharged or purged into an intake tube of the engine, and is burned.

However, the above evaporative system, though rarely, fails during the operation. For example, it is possible that a hole or a crack is formed in the fuel tank or an evaporative gas line extending between the fuel tank and the canister, and that a pipe of the gas line is dislodged out of place. In such a case, there is a possibility that the evaporative gas is not adsorbed by the adsorbent in the canister, but is discharged to the atmosphere. Among diagnosis items, the most important is a leakage diagnosis of the evaporative system, in which the leakage of the evaporative gas is detected during the operation, and a warning (or alarm) is given to the operator in order to prevent air pollution resulting from the failure of the evaporative system.

A method of diagnosing a leakage in an evaporative system is disclosed, for example, in Japanese Patent Unexamined Publication No. 6-10779. In this method, a shut-off valve, leading to a drain, is closed, and a purge control valve is opened, so that the pressure within the evaporative system is once made negative, and in this condition a purge valve is opened, and a leakage is detected from a pressure change in the evaporative system.

Japanese Patent Unexamined Publication No. 3-249366 discloses a method of diagnosing an evaporative system from a change in the air-fuel ratio when a purge control valve is opened and closed. In this method, a purge valve is opened and closed under a high load, and when a change in the air-fuel ratio is detected, the purge valve is again opened and closed under a low load, and the evaporative system is diagnosed from a change of the air-fuel ratio obtained at this time.

Japanese Patent Unexamined Publication No. 6-249095 (U.S. Pat. No. 5,353,771) discloses a method of diagnosing an evaporative system by controlling a purge valve at a duty corresponding to the amount of fuel remaining in a fuel tank.

In the above evaporative system leakage methods, whether the pressure within the sealed system is reduced (to a negative pressure) or increased, the diagnosis is made from a pressure change obtained when a leakage due to the pressure difference from the atmospheric pressure occurs. Therefore, if a pressure variation due to some factor develops inside or outside the evaporative system, the leakage can not be accurately diagnosed.

For example, when evaporative gas is being produced in the fuel tank, and particularly when the amount of production of the evaporative gas is large, the pressure within the system increases. Even during the diagnosis operation, the evaporation of the fuel continues, and therefore it is difficult to distinguish this pressure change from a pressure change due to the leakage, and this invites a gross error in the diagnosis result. Particularly in an environment in which the evaporation of the fuel is promoted (for example, when the amount of the fuel remaining in the fuel tank is small, or after the engine is operated for a long period of time, or when the engine is left for a long period of time in a hot climate), the temperature of the fuel itself is high, and therefore the pressure increase due to the production of the evaporative gas is large, and it is difficult to make a precise diagnosis. In the case of fuels different in volatility from each other, the rate of production of evaporative gas is different even if the remaining fuel amount is the same, so that the rate of rise of the temperature in the evaporative system is different, and this also is the cause of an erroneous diagnosis.

On the other hand, a change in the atmospheric pressure, which is an external environment of the evaporative system, is also a serious problem. With the same diameter of a leak, there is the difference in pressure change between a flatland and a highland at a height of above 2,000 m, and this is also the cause of an erroneous diagnosis. Thus, the diagnosis methods, utilizing a pressure change in the evaporative system, have suffered from problems that an error can be made in the diagnosis of the evaporative system by other pressure variation factors than a leakage, and that it is often difficult to effect the diagnosis itself.

SUMMARY OF THE INVENTION

With the above problems in view, it is an object of this invention to provide an evaporative system in which even if the evaporation of fuel in a fuel tank, as well as a variation in the atmospheric pressure, occurs, a leakage diagnosis of the evaporative system can be accurately effected.

Another object is to provide a method of diagnosing such an evaporative system.

According to one aspect of the present invention, there is provided an evaporative system comprising:

a canister for temporarily receiving evaporative gas, produced in a fuel tank, through an evaporative gas line, a gas purge line having a purge valve for discharging the adsorbed evaporative gas to an intake tube of an engine, and a gauge line branching off from that portion of the gas purge line disposed between the purge valve and the canister, the gauge line communicating with the intake tube of the engine.

The gauge line may communicate directly with the ambient atmosphere, or with a portion having a pressure substantially equal to the atmospheric pressure. However, in order to prevent the contamination of the gauge line, and also to prevent the evaporative gas from being directly discharged from the gauge line to the atmosphere, the gauge line may communicate with that portion of the engine intake tube disposed between an air cleaner and an air flow sensor, or may communicate with that portion of the intake tube disposed upstream of a blow-by gas outlet port, or may communicate with that portion of the intake tube which is disposed upstream of the blow-by gas outlet port and downstream of the air flow sensor.

The gauge line need only to communicate with that portion of the engine intake tube disposed upstream of a throttle valve.

In the evaporative system, a pressure sensor for detecting the pressure in the evaporative system is provided at a point between the purge valve and the fuel tank, or is provided in the fuel tank. A drain valve is provided in a passage, through which fresh air can be introduced into the canister, so as to control the introduction of the fresh air.

A leakage diagnosis of the evaporative system is effected by the following methods:

In a first method, the drain valve, connected to the canister, the purge valve and the gauge valve are closed, and then the purge valve is opened, and when the pressure in the system is brought to a predetermined negative pressure, the purge valve is closed. Then, based on the internal pressure change of the system detected thereafter by the pressure sensor, as well as the internal pressure change of the system detected by the pressure sensor at the time of opening the gauge valve, the leakage diagnosis of the evaporative system is effected.

In a second method, the purge valve is closed, and then based on the internal pressure change of the system detected thereafter by the pressure sensor, as well as the internal pressure change of the system obtained when the gauge valve is opened a predetermined time period after the closing of the purge valve, the leakage diagnosis of the evaporative system is effected.

In a third method, the drain valve, connected to the canister, the purge valve and the gauge valve are closed, and then the purge valve is opened, and when the pressure in the system is brought to a predetermined negative pressure, the purge valve is closed. Then, the leakage diagnosis of the evaporative system is effected based on the internal pressure change of the system detected thereafter by the pressure sensor, as well as the internal pressure change of the system obtained by a process in which the purge valve is again opened a predetermined time period after the closing of the purge valve, and when the internal pressure of the system becomes a predetermined negative pressure, the purge valve is closed, and then the gauge valve is opened.

In a fourth method, the diagnosis step of the third method is effected a plurality of times.

In some cases, it is desirable not to effect these diagnoses, depending on the operating condition of the engine.

First, the diagnoses should not preferably be effected when operating parameters of the engine are in their respective predetermined states or predetermined varying states. Such engine-operating parameters include the degree of opening of a throttle valve, the intake air amount, the pressure in the intake tube, and the engine speed. When these parameters or their change rates brought into their respective predetermined values, or come into their respective diagnosis mask ranges, it is desirable not to effect the above diagnoses.

Secondly, the diagnosis is masked when the internal pressure of the system, detected by the pressure sensor, or the change rate of this pressure, becomes a predetermined value, or becomes more than a predetermined value.

Thirdly, the diagnosis is effected when the opening and closing operation of the gauge valve is proper, and when it is judged that the opening and closing operation of the gauge valve is abnormal, the diagnosis is masked.

The diameter of the line (or piping) in the evaporative system is larger than the diameter of a gauge orifice of the gauge valve.

DESCRIPTION OF THE PREFERRED EMBODIMENTS

Figure 1:
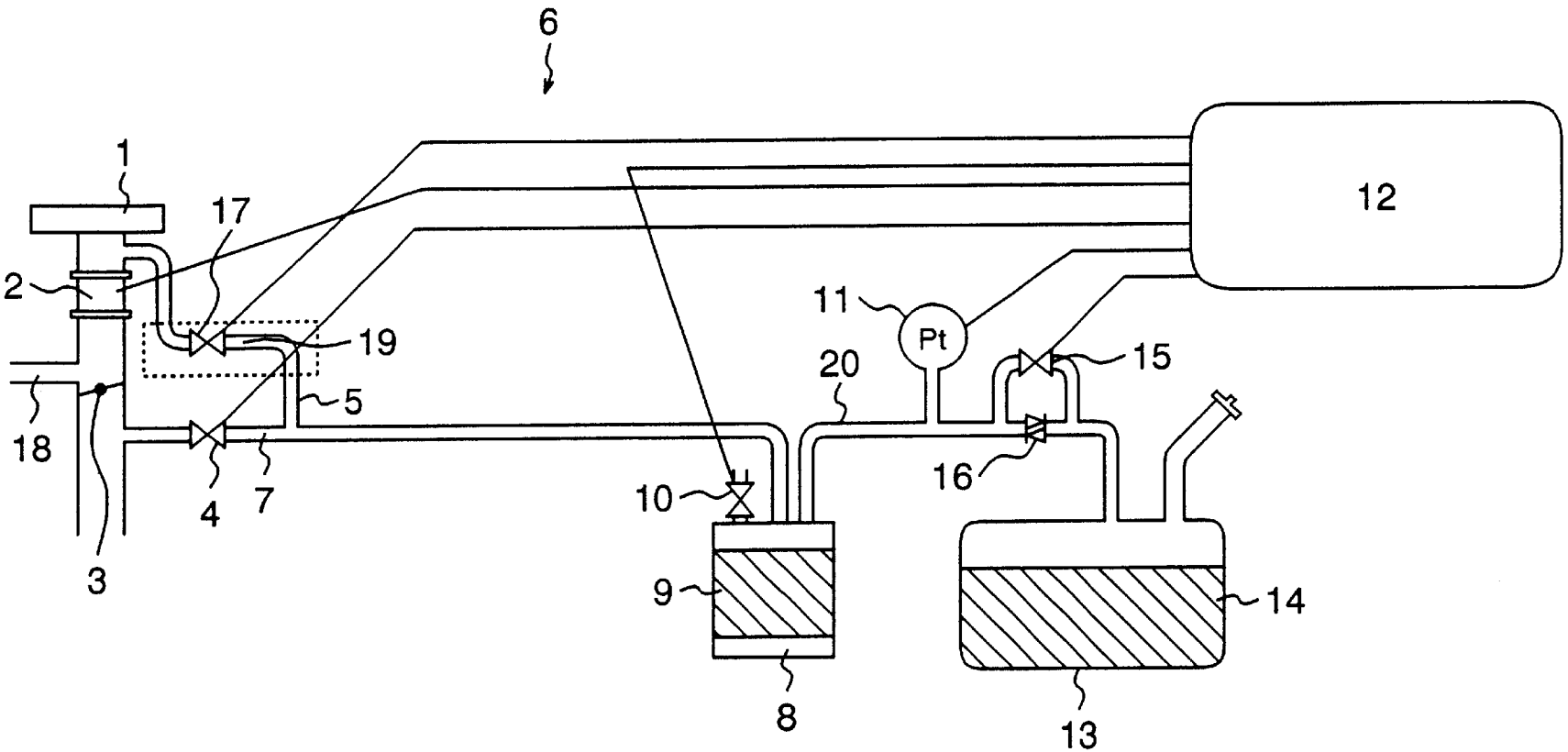
FIG. 1 is a view showing the construction of a first embodiment of the present invention.
Figure 3:
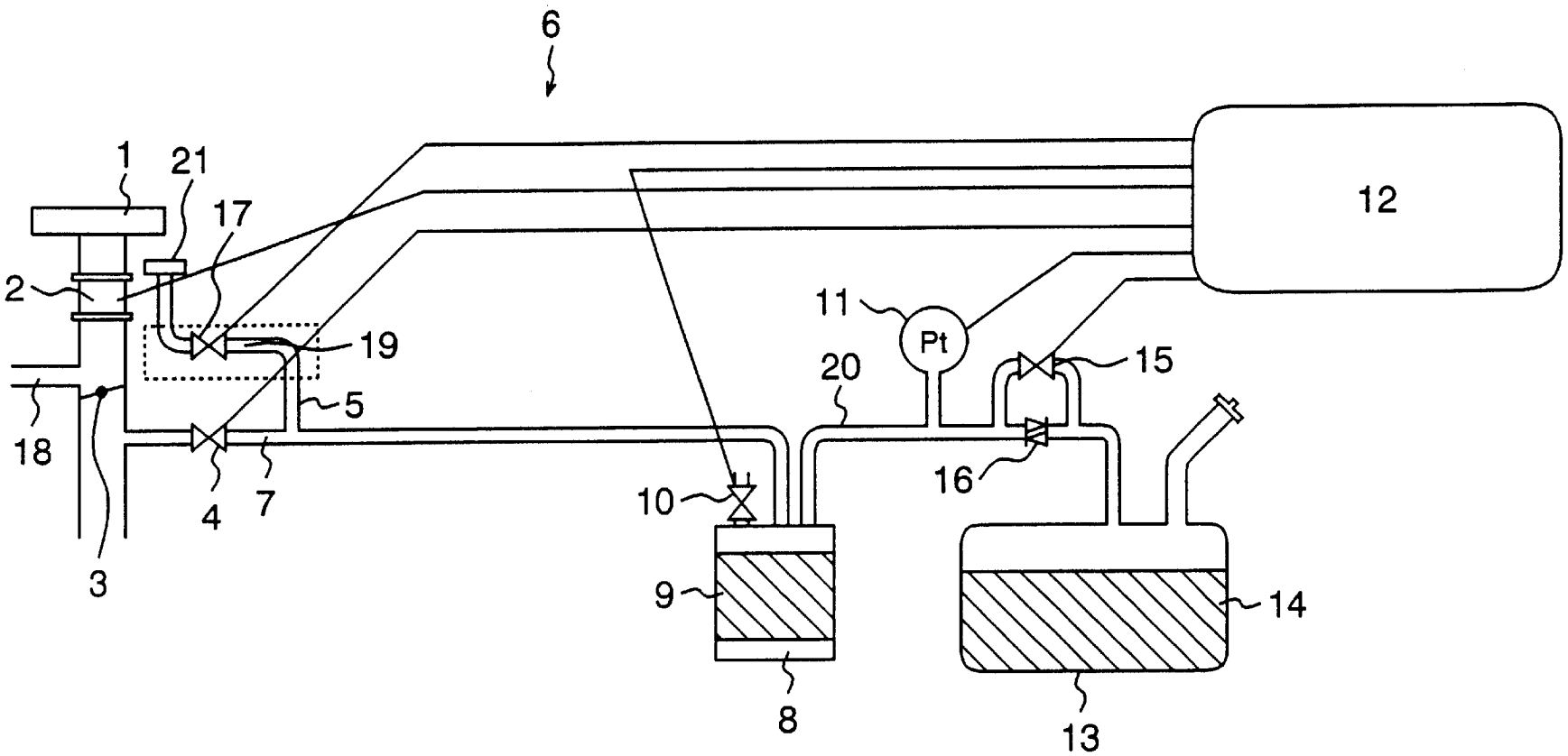
FIG. 3 is a view showing the construction of a further embodiment of the present invention.

FIG. 1 shows a preferred embodiment of a system of the present invention. An ECU (electronic control unit) 12 receive a signal from an air flow sensor 2 and a signal from a pressure sensor 11, and controls a purge valve 4, a drain valve 10, a by-pass valve 15 and a gauge valve 17. Evaporated fuel (evaporative gas) flows from a fuel tank 13, holding fuel 14, via an evaporative gas line 20, and is adsorbed by an adsorbent 9 in a canister 8. The thus adsorbed fuel is discharged or purged to a downstream side of a throttle valve 3 of an engine via a purge line 7, and is burned. The purge valve 4 is provided on the purge line 7, and controls a purge timing and a purge amount. The fuel tank 13 and the canister 8, containing the adsorbent 9, are connected together through a check valve 16. The check valve 16 is operated to allow the evaporative gas, produced in the fuel tank 13, to be adsorbed by the adsorbent 9 only when the pressure within the fuel tank 13 exceeds a predetermined level. One example of this check valve 16 is opened and closed by the pressure difference from the atmospheric pressure, and another example of the check valve 16 is opened and closed by a pressure differential across the check valve 16 (that is, the pressure difference between the opposite sides of the check valve 16). When the pressure within the fuel tank 13 becomes higher a predetermined value (10 to 20 mmHg) than the atmospheric pressure or the pressure at the canister side of the check valve 16 leading to the canister 8, the check valve 16 is opened, so that the evaporative gas, produced in the fuel tank 13, flows into the canister 8, and is adsorbed by the adsorbent 9. On the other hand, when the pressure within the fuel tank 13 becomes lower a predetermined value (minus several umHg) than the atmospheric pressure or the pressure at the canister side of the check valve 16, the check valve 16 is opened, so that the ambient atmosphere flows through the drain valve 10 into the fuel tank 13, thereby preventing the pressure within the fuel tank 13 from decreasing to an unduly-negative pressure. In the evaporative system 6 of this construction, the by-pass valve 15 is operated to connect the fuel tank 13 directly to the canister 8 while by-passing the check valve 16. The pressure sensor 11 detects the pressure (internal pressure) in the evaporative system 6. The drain valve 10 is provided in a fresh air inlet port (drain), and is operated to shut off the introduction of fresh air from the drain. A gauge line 5, branching off from the purge line 7, connects the purge line 7 to an intake tube via a gauge orifice 19 and the gauge valve 17. The gauge line 5 may communicate directly with the atmosphere (as shown in FIG. 3 in which a filter 21 is attached to the distal end of the gauge line 5 to protect the gauge valve 17 and the gauge orifice 19 from contamination). However, in order to protect the gauge valve 17 and the gauge orifice 19 from contamination and also to prevent the evaporative gas from being discharged to the atmosphere when the gauge valve 17 fails while kept in an open condition, it is preferred that the gauge line 5 lead to the engine.

Figure 2:
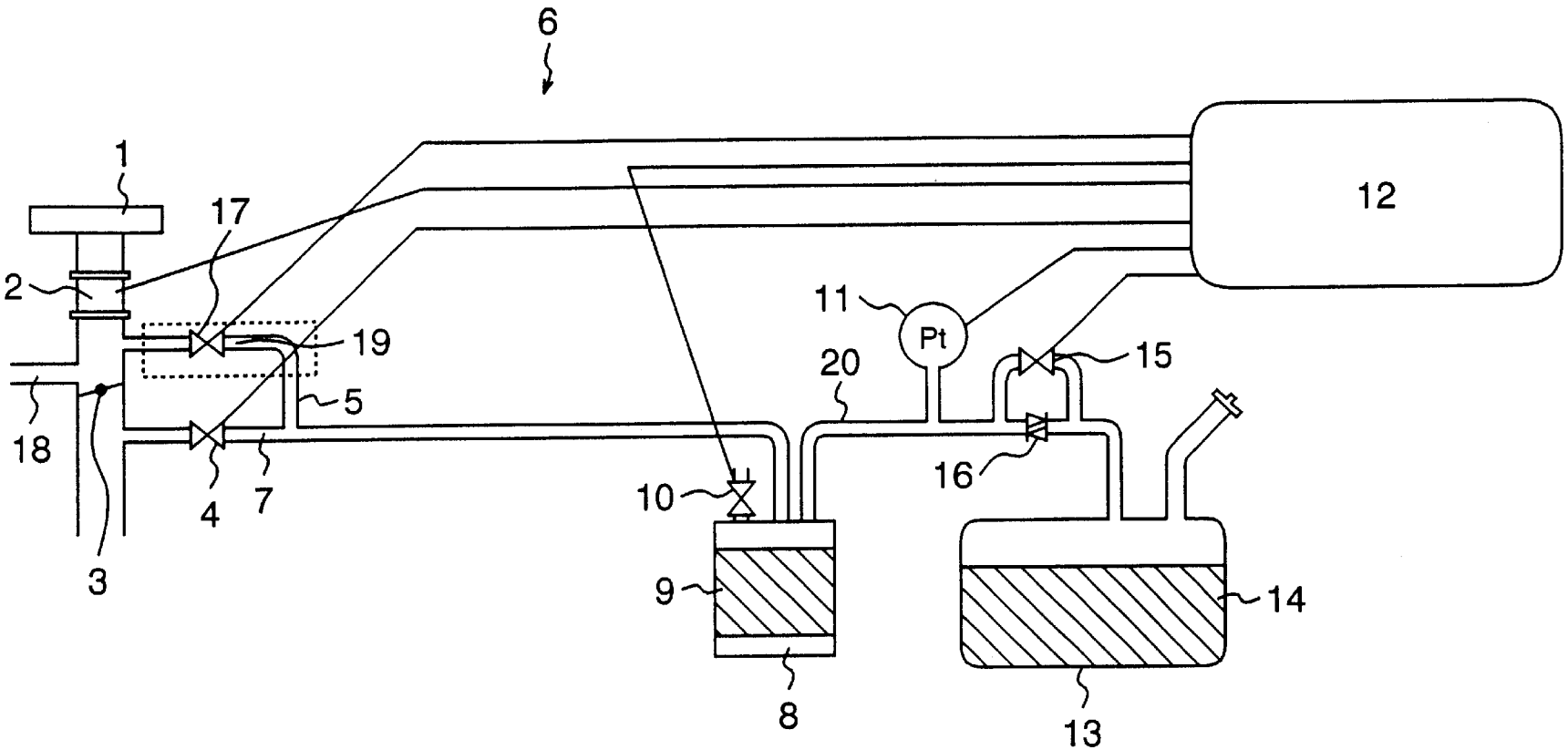
FIG. 2 is a view showing the construction of another embodiment of the present invention.

In this embodiment, although the gauge line 5 is connected to a point between an air cleaner 1 and the air flow sensor 2, it is preferred that the gauge line 5 be connected to a point upstream of a blow-by gas outlet port 18 so that the gauge orifice 19, included in the gauge valve 17, will not be clogged by blow-by gas or the like. FIG. 2 shows an embodiment which achieves such a construction in which a pressure gauge line is connected to a point upstream of the blow-by gas outlet port 18. The ECU 12 controls the purge valve 4, the gauge valve 17, the drain valve 10 and the by-pass valve 15, and measures and processes the pressure in the evaporative system 6, thereby judging the amount of evaporative gas leaking to the atmosphere.

Figure 4:
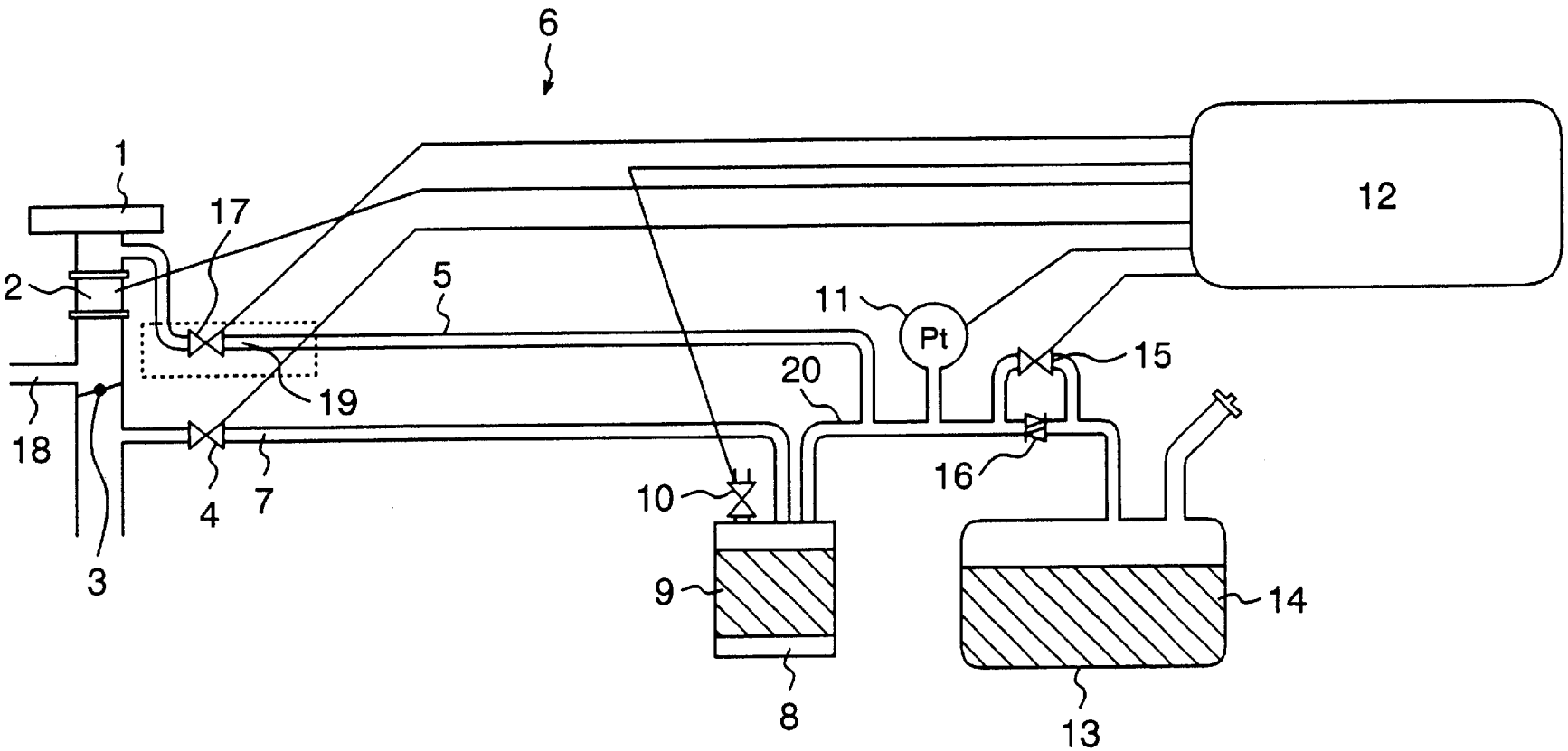
FIG. 4 is a view showing the construction of a further embodiment of the present invention.

In the above embodiment, although the gauge line 5 branches off from the purge line 7, the gauge line 5 may branch off from the fuel tank 13 or the evaporative gas line 20, depending on the construction of the evaporative system. FIG. 4 shows such an example in which a gauge line 5 branches off from the evaporative gas line 20.

Figure 5:
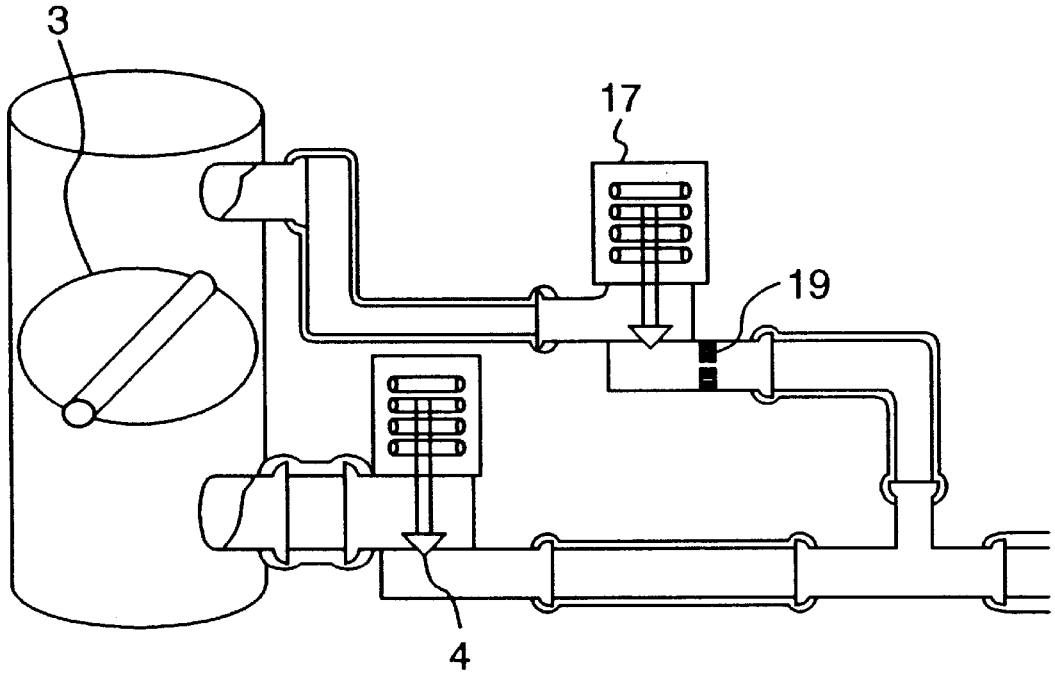
FIG. 5 is a view showing one example of construction including a gauge valve, a gauge orifice and a purge valve.

FIG. 5 shows the construction of the gauge valve 17 and the construction of the purge valve 4 used in this embodiment. The gauge valve 17 is an ON-OFF valve which is electrically opened and closed, and includes the gauge orifice 19. The purge valve 14 is a duty valve which is electrically controlled, and controls an equivalent opening area. In this embodiment, although the gauge valve 17 is the ON-OFF valve as described above, a duty valve or a valve of the stepping motor-type may be used as the gauge valve 17. In this case, by controlling an equivalent opening area, the function of the orifice 19 is achieved, and the provision of the gauge orifice 19 can be omitted.

The position of provision of the pressure sensor 11 in the evaporative system 6 will be described with reference to FIGS. 6 to 8.

Figure 6:
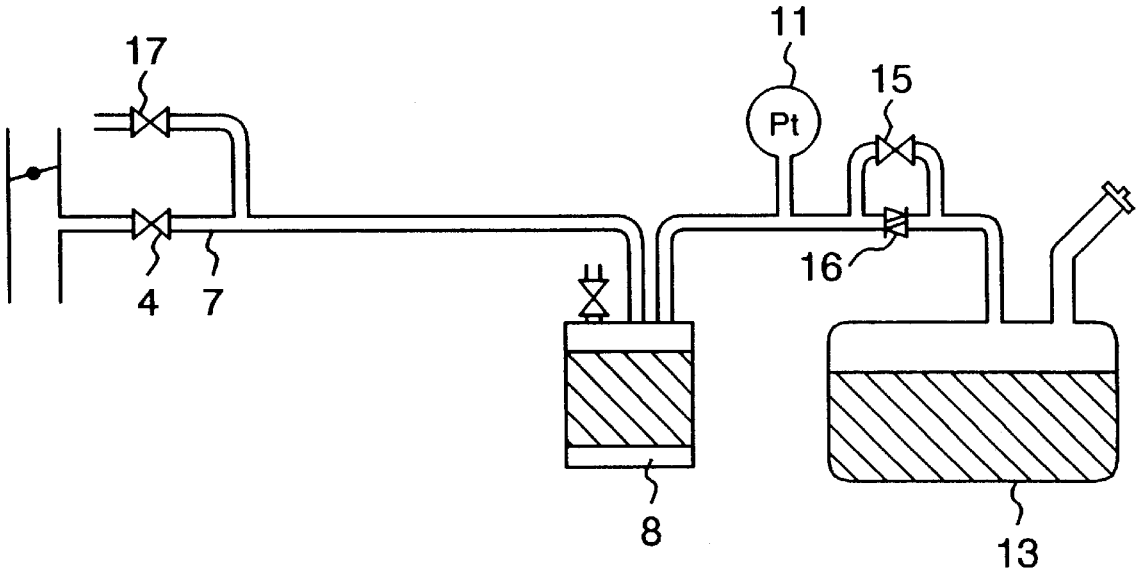
FIG. 6 is a view showing one example of an installation position of a pressure sensor.

In FIG. 6, the fuel tank pressure sensor 11 is provided between the canister 8 and the check valve 16 and also between the canister 8 and the by-pass valve 15. In this case, when the drain valve 10 is closed in a closed condition of the by-pass valve 15, and the purge valve 14 is opened to introduce a negative pressure from the intake tube, the check valve 16 is not opened (depending on the kind of the valve 16, the check valve 16 is opened by the pressure difference between the canister side and the fuel tank side of the valve 16, and in such a case the degree of the negative pressure to be introduced must be specified), and therefore a leakage judgment can be made for the evaporative system 6 except that portion of the evaporative system 6 extending from the by-pass valve 15 and the check valve 16 to the fuel tank 13. The drain valve 10 is closed in the closed condition of the by-pass valve 15, and the purge valve 14 is opened to introduce a negative pressure from the intake tube, and then the gauge valve 17 is opened, and a pressure change is measured, and by doing so, the operation of the gauge valve 17 and the cross-sectional area Ag of the gauge orifice 19 can be diagnosed. The drain valve 10 is closed in the closed condition of the by-pass valve 15, and the gauge valve 17 is opened, so that the pressure upstream of the gauge valve 17 can be measured. Therefore, if the upstream side of the gauge valve 17 is connected to the downstream side of the air cleaner 1, the clogging of the air cleaner 1 can be judged. The construction of FIG. 6 is suitable for effecting the above judgements, but it is necessary to take it into consideration that through the influence of a pressure loss, developing in the line between the fuel tank 13 and the pressure sensor 11, and the flow through the line (piping), the measured value may deviate slightly from the pressure within the fuel tank 13.

Figure 7:
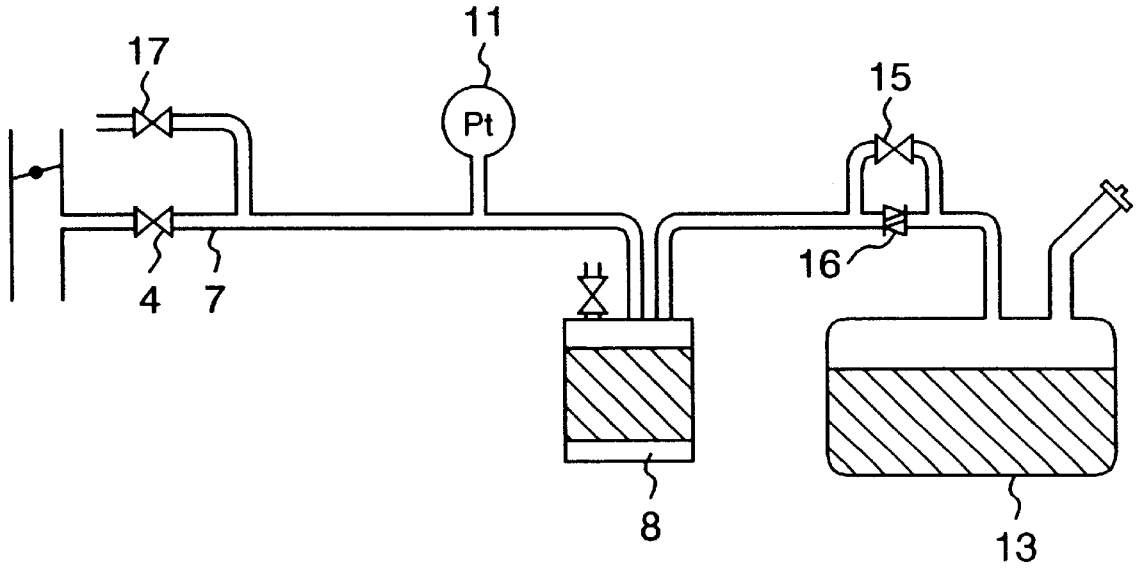
FIG. 7 is a view showing another example of an installation position of the pressure sensor.

In FIG. 7, the pressure sensor 11 is provided between the canister 8 and the purge valve 4. This construction has similar features as described for FIG. 6. However, the influence of the pressure loss and so on is greater. And besides, in this case, even if the line is clogged when the negative pressure is introduced, the unduly-negative pressure below the negative pressure measured by the pressure sensor will not be applied to the canister 8, and therefore this construction is suitable when the canister 8 is not sufficiently pressure-resistant.

Figure 8:
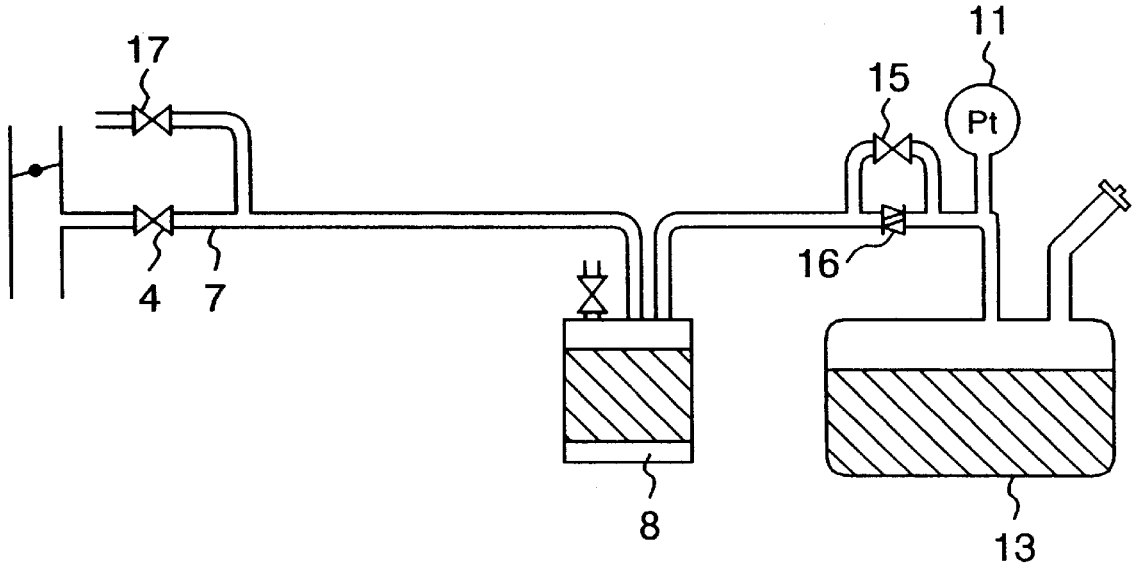
FIG. 8 is a view showing a further example of an installation position of the pressure sensor.

In FIG. 8, the pressure sensor 11 is provided between the fuel tank 13 and the check valve 16 and also between the fuel tank 13 and the by-pass valve 15, or is provided in the fuel tank 13. In this case, the pressure of the evaporative system 6 can be measured most accurately. However, this construction is not suitable for the diagnosis of the gauge valve 17 and the judgment of clogging of the air cleaner 1 as described in FIGS. 6 and 7. For effecting these judgments, it is necessary to provide another pressure sensor or to provide switch means for switching the connection of the pressure sensor As described above, the above constructions have their respective features, and it is necessary to select the position of provision of the pressure sensor 11 according to the purpose. When the sensor provision position is limited for installation reasons, it is preferred that the control constants should be suitably determined in view of the features of the sensor provision position.

Figure 9:
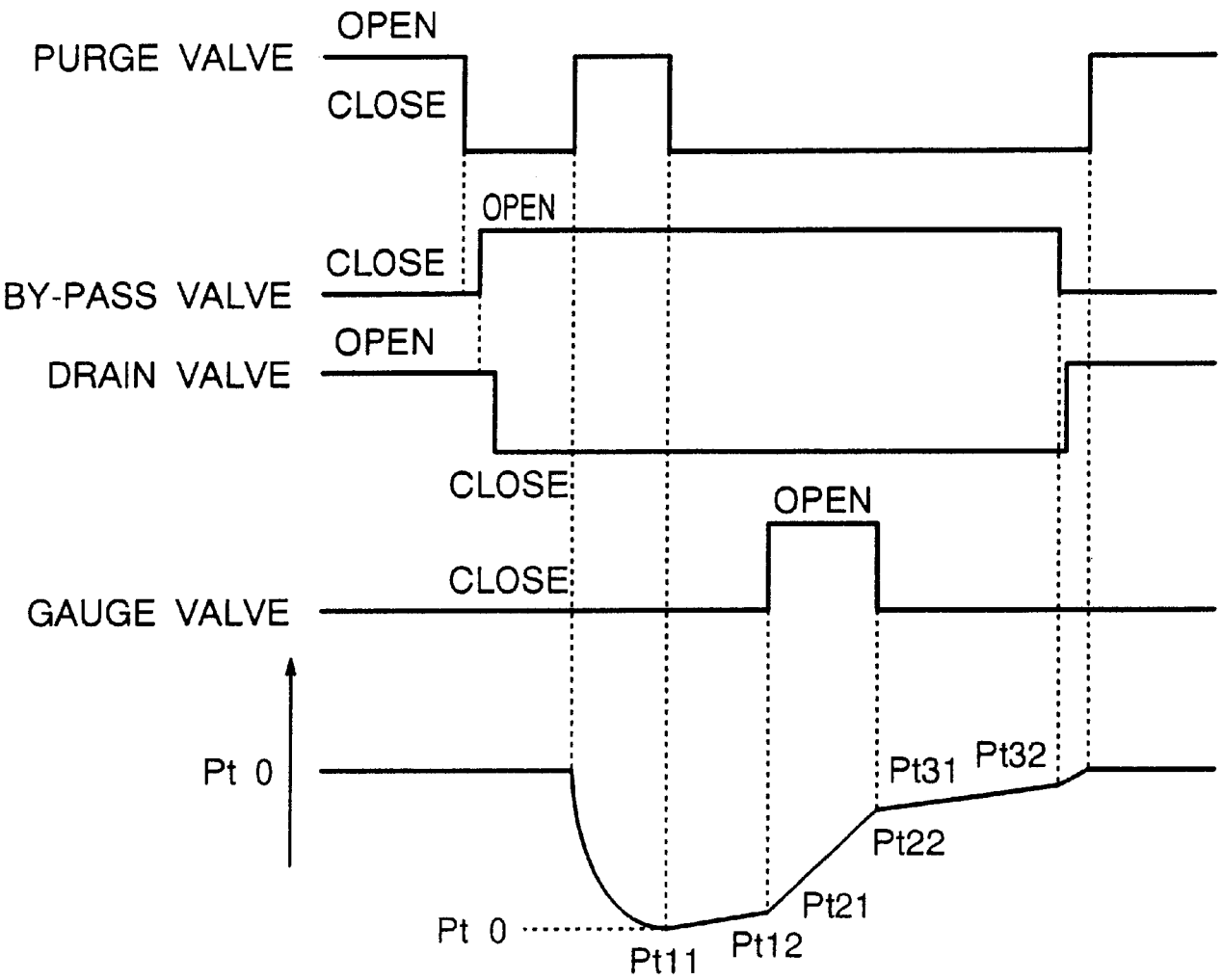
FIG. 9 is a diagram showing operating timings of valves and a pressure change for a diagnosis.

FIG. 9 shows the operating timings of the valves necessary for the diagnosis of the evaporative system, as well as a pressure change in the evaporative system.

Usually, the gauge valve 17 and the by-pass valve 15 are closed, and the drain valve 10 is opened. When the pressure of the evaporative gas, produced within the fuel tank 13, exceeds the predetermined level, the check valve 16 is opened, and the evaporative gas is adsorbed by the adsorbent 9 in the canister 8. When the purge valve 4 is opened in accordance with the operating condition of the engine, the air is introduced through the drain valve 10 open to the atmosphere since the interior of the intake tube is under a negative pressure, and the adsorbed evaporative gas separates from the adsorbent 9, and is fed, together with the thus introduced air, to the intake tube, and is used for combustion in the engine. Thus, the fuel vapor, produced in the fuel tank 13, is prevented from being discharged to the atmosphere.

For diagnosing the evaporative system, first, the purge valve 4 is once closed, and the by-pass valve 15 is opened, and the drain valve 10 is closed. In this condition, the evaporative system 6, including the fuel tank 13, forms a one closed space. Then, when the purge valve 4 is opened, the pressure in the evaporative system 6 is rapidly reduced in pressure (this will be hereinafter often referred to as "pull-down"). The differential pressure Pt (i.e., pressure difference) from the atmospheric pressure Pa is measured by the pressure sensor 11, and when the differential pressure Pt becomes smaller than a predetermined pressure Pt0 (set to about −20 mmHg to about −30 mmHg smaller), the purge valve 4 is closed, and the differential pressure Pt11 is measured. Thus, the interior of the evaporative system is again sealed, and therefore if there is no leakage, the pressure is kept constant. However, if there exists a leakage anywhere in the evaporative system, the pressure gradually approaches the atmospheric pressure in accordance with the degree of the leakage. When a predetermined time T1 elapses or when the pressure change becomes greater than a predetermined value (this is determined either when the amount of change from Pt11 becomes a predetermined value or when Pt itself becomes a predetermined value different from Pt11), the differential pressure Pt12 is measured. Then, the gauge valve 17 is opened, and the differential pressure Pt21 is measured, and when a predetermined time T2 elapses or when the pressure change becomes greater than a predetermined value, the differential pressure Pt22 is measured. Then, the gauge valve 17 is closed, and the differential pressure Pt31 is measured, and when a predetermined time T3 elapses or when the pressure change becomes greater than a predetermined value, the differential pressure Pt32 is measured. Then, the by-pass valve 15 is closed, and the drain valve 10 is opened, and the purge valve 4 is opened (thereby returning the evaporative system to the normal control condition). The above process is effected under the control of the ECU 12, and based on the measured values of the differential pressures Pt11, Pt12, Pt21, Pt22, Pt31 and Pt32, it is judged whether or not there is any leakage in the evaporative system 6.

At the initial stage of the above process, if the opening of the by-pass valve 15 is effected a predetermined time period after the closing of the purge valve 4, the atmospheric pressure is applied to the pressure sensor 11 through the drain valve 10, and therefore at this time a deviation of the output of the pressure sensor 11 from the atmospheric pressure (a deviation from 0 in the case of a differential pressure sensor) is measured, and thereafter the measured values of the pressure are corrected, and by doing so, an error of the pressure sensor can be corrected.

Figure 10:
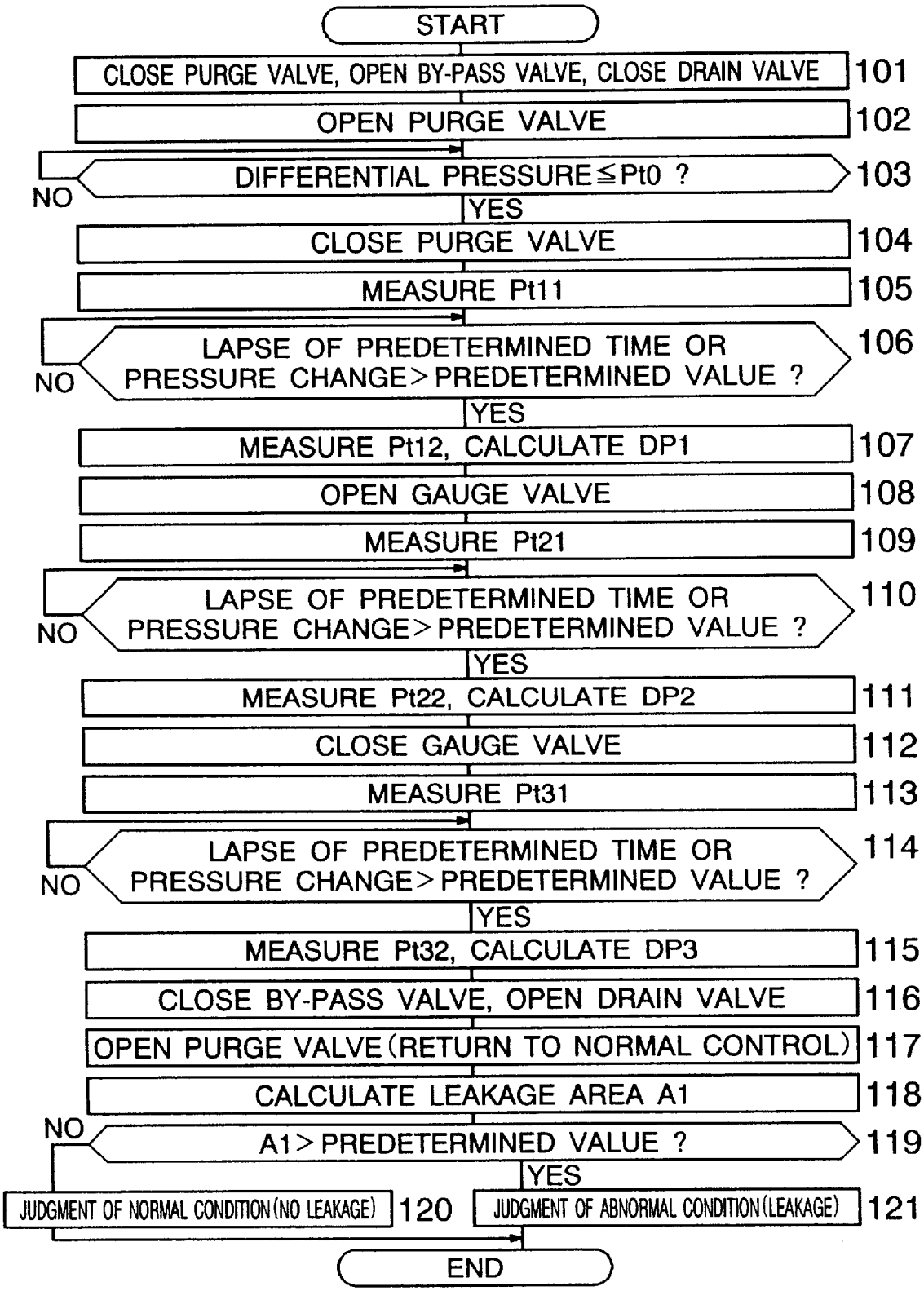
FIG. 10 is a flow chart showing a diagnosis process.

FIG. 10 is a flow chart showing the diagnosis processing effected by the ECU 12. In Step 101, the purge valve 4 is closed, and the by-pass valve 15 is opened, and the drain valve 10 is closed, so that the evaporative system 6 forms the closed space. In Step 102, the purge valve 4 is opened. The gas in the evaporative system is drawn into the intake tube kept under a negative pressure, so that the pressure in the evaporative system is rapidly reduced. When the differential pressure reaches the predetermined pressure Pt0, the purge valve 4 is closed in Step 104, and Pt11 is measured in Step 105. When the predetermined time elapses or when the pressure change becomes greater than the predetermined value, Pt12 is measured in Step 107, and the pressure change, DP1=(Pt12−Pt11)/the required time, due to a leakage is calculated using Pt11 and Pt12. Then, the gauge valve 17 is opened in Step 108, and Pt21 is measured in Step 109. When the predetermined time elapses or when the pressure change becomes greater than the predetermined value, Pt22 is measured in Step 111, and the pressure change, DP2=(Pt22−Pt21)/the required time, due to a leakage and the inflow through the gauge orifice 19 is calculated using Pt21 and Pt22. Then, the gauge valve 17 is closed once more in Step 112, and Pt31 is measured in Step 113. When the predetermined time elapses or when the pressure change becomes greater than the predetermined value, Pt32 is measured in Step 115, and the pressure change, DP3=(Pt32−Pt31)/the required time, due to a leakage is calculated using Pt31 and 32. The program constants are so determined that the differential pressure Pt becomes substantially 0 (that is, the pressure becomes substantially equal to the atmospheric pressure), at this time. By doing so, the pressure change due to the leakage almost disappears, and the pressure rise by the evaporative gas is predominant. Therefore, DP3 represents the pressure change by the evaporative gas. By the above process, the measurements required for the leakage judgment are completed, and therefore in order to return the evaporative system into the normal condition, in Step 116, the by-pass valve 15 is closed, and also the drain valve 10 is opened, and in Step 117, the purge valve 4 is opened (thereby returning the evaporative system to the normal control condition). By using the above measured results, a leakage area Al is obtained by the following formulae in Step 118.

If $Pa \geqq P$ is established, the pressure P (absolute pressure) in the sealed interior of the evaporative system 6 is basically expressed by the following formula (1):

$$dP/dt=(RT/V)[A\sqrt{\{2\rho(Pa-P)\}}+k(Ps-Pg)] \quad (1)$$

where A represents a leakage area (including the cross-sectional area of the gauge orifice 19 when the gauge valve 17 is opened), R represents the gas constant, T represents the temperature of the gas in the evaporative system, V represents the volume of the evaporative system, ρ represents the atmosphere density, Pa represents the atmospheric pressure, Ps represents a saturated vapor pressure, Pg a partial pressure of the evaporative gas, and k represents an evaporation rate. The differential pressure Pt is represented by Pt= P−Pa. Among these, the volume V of the evaporative system is a state parameter variable by the amount of the fuel remaining in the fuel tank 13, and the atmosphere density ρ is a state parameter variable by the altitude (atmospheric pressure) and the air (ambient) temperature, and the evaporation rate k (Ps−Pg) of the evaporative gas is a state parameter variable by the temperature of the fuel and others. The results of the measurements of the differential pressure and others for the leakage judgment are influenced by these state parameters. In order to remove the influence of these state parameters, the leakage area A1 is obtained by the following formula (2), using the formula (1) as well as the differential pressure values Pt11, Pt12, Pt21 and Pt22 and the pressure change rate values DP1, DP2 and DP3 which are the measurement results of the above process:

$$A1=Ag/\{(DP2-DP3)/(DP1-DP3)\sqrt{(Pt1/Pt2)-1}\} \quad (2)$$

where Ag represents the cross-sectional area of the gauge orifice 19, and Pt1=(Pt11+Pt12)/2 and Pt2=(Pt21+Pt22)/2 are established.

If the leakage area A1 is more than a predetermined value (threshold value for the leakage judgment), it is judged in Step 121 that the condition is abnormal. Further, a warning (or alarm) may be given to the operator, and a failure code or the operating condition at the time of detecting a failure may be memorized or stored, and a fail-safe process may be effected according to a predetermined program. If the leakage area A1 is less than the predetermined value, it is judged in Step 120 that the condition is normal.

In this embodiment, as is clear from the comparison of the formula (2) with the formula (1), the volume V of the evaporative system and the atmosphere density ρ in the formula (1) are eliminated in the formula (2). Therefore, it is not necessary to measure these parameters, and additional measurement means for measuring these parameters does not need to be provided. And besides, the result of the leakage judgment will not be affected or influenced by an error in such measurement. Furthermore, k(Ps−Pg), representing the fuel evaporation rate, can be almost eliminated by finding the pressure change DP3 in the condition in which the differential pressure in the evaporative system is substantially 0, and then by applying it to the formula (2).

Figure 11:
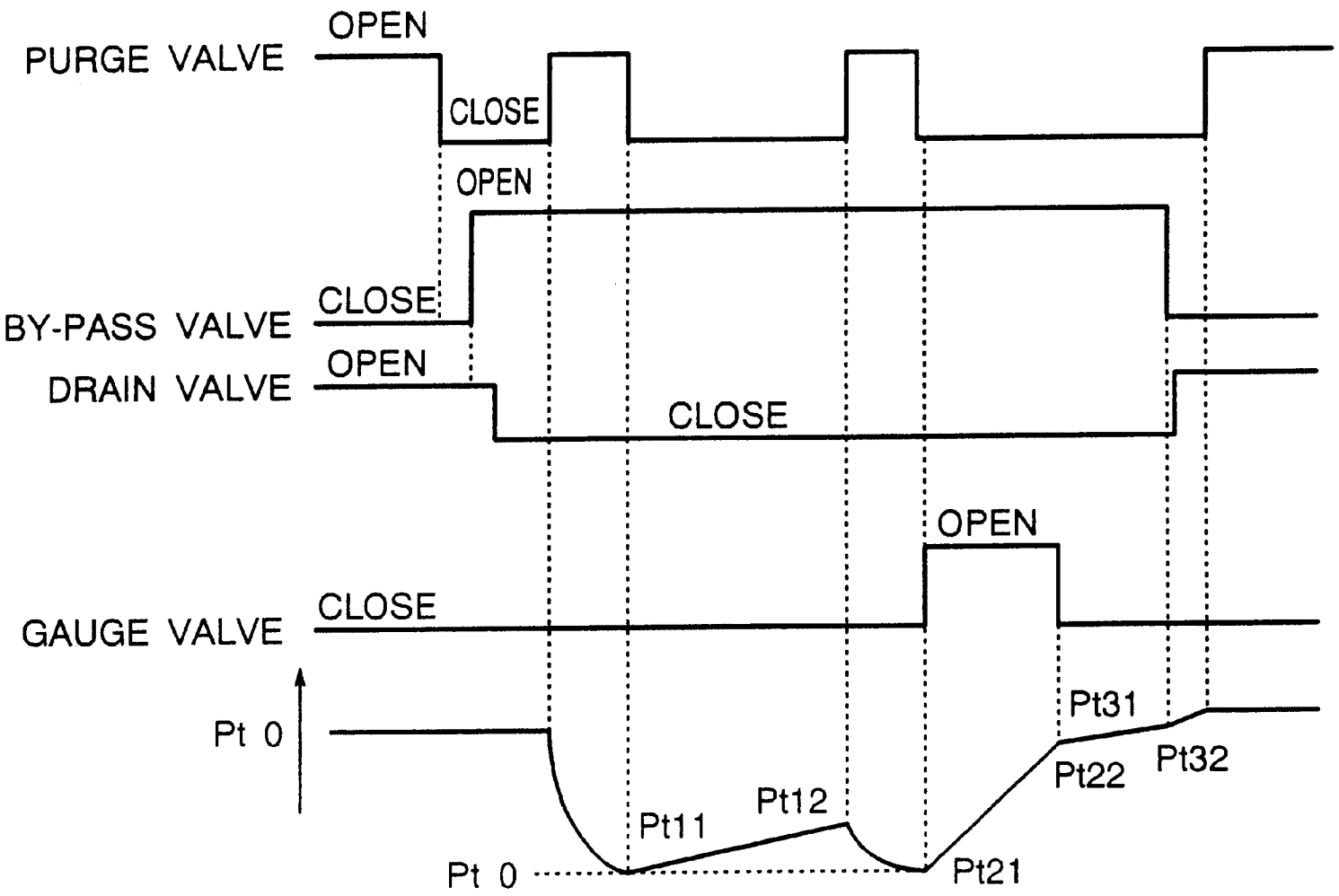
FIG. 11 is a diagram showing operating timings of the valves and a pressure change for a diagnosis.

Another method (another embodiment), in which the procedure of operating the valves is different, will now be described. The operating timings of the valves for effecting the diagnosis, as well as a pressure change in the evaporative system, will first be described with reference to FIG. 11. For effecting a leakage diagnosis, first, the purge valve 14 is once closed, the by-pass valve 15 is opened, and the drain valve 10 is closed. Then, the purge valve 14 is opened, thereby reducing (pulling down) the pressure in the evaporative system 6. The differential pressure Pt of the fuel tank 13 is measured, and when the differential pressure Pt becomes smaller than a predetermined pressure Pt0, the purge valve 4 is closed, and the differential pressure Pt11 is measured. When a predetermined time T1 elapses or when the pressure change becomes greater than a predetermined value, the differential pressure Pt12 is measured. Then, the purge valve 4 is again opened, thereby pulling down the pressure. When the differential pressure Pt becomes greater than the predetermined pressure Pt0, the purge valve 4 is opened, further the gauge valve 17 is opened, and the differential pressure Pt21 is measured. When a predetermined time T2 elapses or when the pressure change becomes greater than a predetermined value, the differential pressure Pt22 is measured. Then, the gauge valve 17 is closed, and the differential pressure Pt31 is measured, and when a predetermined time T3 elapses or when the pressure change becomes greater than a predetermined value, the differential pressure Pt32 is measured. Then, the by-pass valve 15 is closed, the drain valve 10 is opened, and the purge valve 4 is opened (thereby returning the evaporative system to the normal condition).

Figure 12:
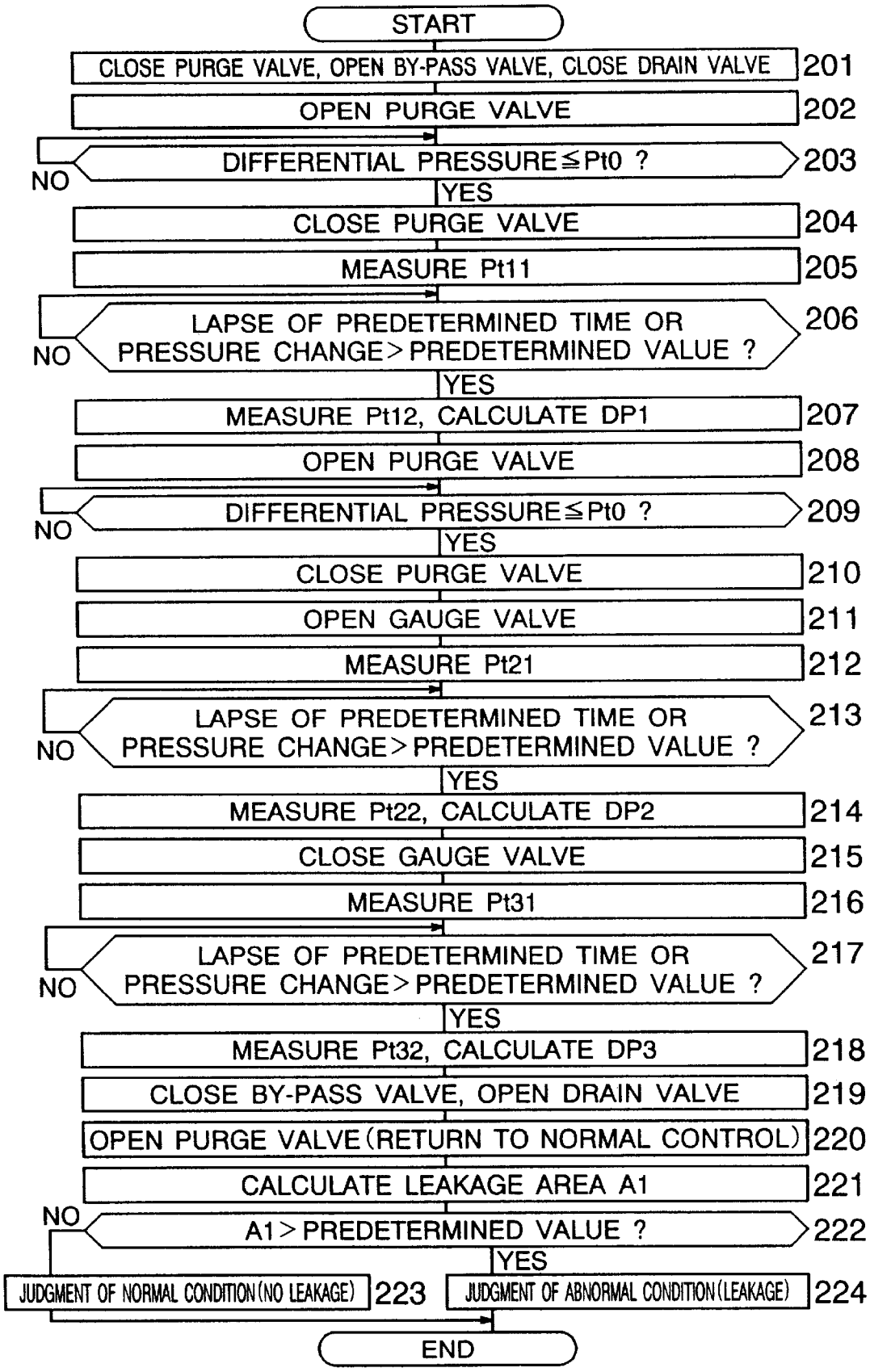
FIG. 12 is a flow chart showing a diagnosis process.

Next, a flow chart of the diagnosis processing effected by the ECU 12 will be described with reference to FIG. 12. The purge valve 4 is closed, the by-pass valve 15 is opened, and the drain valve 10 is closed, so that the evaporative system 6 forms a closed space. In this condition, the purge valve 4 is opened to reduce the pressure in the evaporative system. When the pressure reaches the predetermined pressure Pt0, the purge valve 4 is closed, and Pt11 is measured. When the predetermined time elapses or when the pressure change becomes greater than the predetermined value, Pt12 is measured, and the pressure change, DP1=(Pt12−Pt11)/the required time, due to a leakage is calculated using Pt11 and Pt12. Then, in Step 208, the purge valve 4 is again opened to pull down the pressure in the evaporative system. When the differential pressure Pt becomes smaller than the predetermined pressure Pt0, the purge valve 4 is closed in Step 210, and the gauge valve 17 is opened in Step 211, and the differential pressure Pt21 is measured in Step 212. When the predetermined time elapses or when the pressure change becomes greater than the predetermined value, Pt22 is measured in Step 214, and the pressure change, DP2=(Pt22−Pt21)/the required time, due to a leakage and the inflow through the gauge orifice 19 is calculated using Pt21 and Pt22. The gauge valve 17 is closed once more in Step 215, and Pt31 is measured in Step 216. When the predetermined time elapses or when the pressure change becomes greater than the predetermined value, Pt32 is measured in Step 218, and the pressure change, DP3=(Pt32−Pt31)/the required time, due to a leakage is calculated using Pt31 and Pt32. The program constants are so determined that the differential pressure Pt becomes substantially 0 (that is, the pressure becomes substantially equal to the atmospheric pressure) at this time, and by doing so, DP3 represents the pressure change due to the evaporative gas. By the above process, the measurements required for the leakage judgment are completed, and therefore in order to return the evaporative system into the normal condition, in Step 219, the by-pass valve 15 is closed, and also the drain valve 10 is opened, and in Step 220, the purge valve 4 is opened (thereby returning the evaporative system to the normal control condition). Using the above measurement results, the leakage area A1 is obtained by the following formula (3), utilizing the above formula (2):

$$A1=Ag/\{(DP2-DP3)/(DP1-DP3)\sqrt{(Pt1/Pt2)-1}\}\approx Ag(DP1-DP3)/(DP2-DP1) \quad (3)$$

Thus, since Pt1−Pt2 and hence $\sqrt{(Pt1/Pt2)}\approx 1$ are established, the calculation formula can be simplified. Naturally, the calculation may be made using the formula (2), and in this case, also, since Pt1−Pt2 is established, there is an advantage that the calculation of $\sqrt{(Pt1/Pt2)}$ is easy. There is another advantage that even if there should occur an error in the differential pressure Pt which is the value measured by the pressure sensor 11, the calculation result is less affected.

If the leakage area A1 is more than a predetermined value (threshold value for the leakage judgment), it is judged in Step 224 that the condition is abnormal. If the leakage area A1 is less than the predetermined value, it is judged in Step 223 that the condition is normal.

One important feature of the above embodiments is that in the condition in which the pressure difference from the atmospheric pressure is developing, the pressure change is measured in the open condition of the gauge valve 17, and also measured in the closed condition of the gauge valve 17. Another important feature is that in the condition in which there is almost no pressure difference from the atmospheric pressure, the pressure change is measured in order to detect the influence of the pressure rise due to the evaporative gas. Therefore, the procedure of opening and closing the valves, the order and frequency of the measurements are not limited to the above embodiments. For example, in order to enhance the precision, there may be used a method in which the measurement is repeated several times to measure the pressure change, and the leakage area is found by the average value of these measured values. The pressure change values DP1, DP2 and DP3, as well as the pressure values P1 and P2 may not be measured successively (in which case, for example, the pressure is pulled down, and the gauge valve 17 is closed, and in this condition the pressure change is measured, and upon lapse of a predetermined time, the pressure is again pulled down, and the pressure change is measured in the open condition of the gauge valve 17), but it will suffice that all the measurements are completed within a time period during which the amount of the remaining fuel, the atmosphere density and so on are hardly changed. This enlarges the opportunity of completing the diagnosis even if the times, at which the condition suitable for the diagnosis are available, are not consecutive or successive. Furthermore, the timings of measuring the differential pressure at the various points are not limited to those described in the above embodiments. For example, in some cases, it takes several seconds for the pressure in the evaporative system to become stable after the purge valve or the gauge valve is opened and closed, and therefore the measurement may be effected a predetermined time period after the valve is opened and closed, or after the pressure changes a predetermined amount. Further, the calculation formulas are not limited to those described in the above embodiment. For example, if the pressure change is represented by $DPx=(\sqrt{Ptx2}-\sqrt{Ptx1})/\text{lapse time}$ (where x=1, 2), the estimated precision of the leakage area can be enhanced.

Next, a method of inhibiting or interrupting the diagnosis of the evaporative system according to the present invention will be described.

For example, when any of the parts of evaporative system or any of engine control parts is subjected to a malfunction or failure, so that the accurate diagnosis of the evaporative system can not be effected, the diagnosis is inhibited in order to avoid an erroneous judgment, or is interrupted if during the diagnosis operation.

Figure 13:
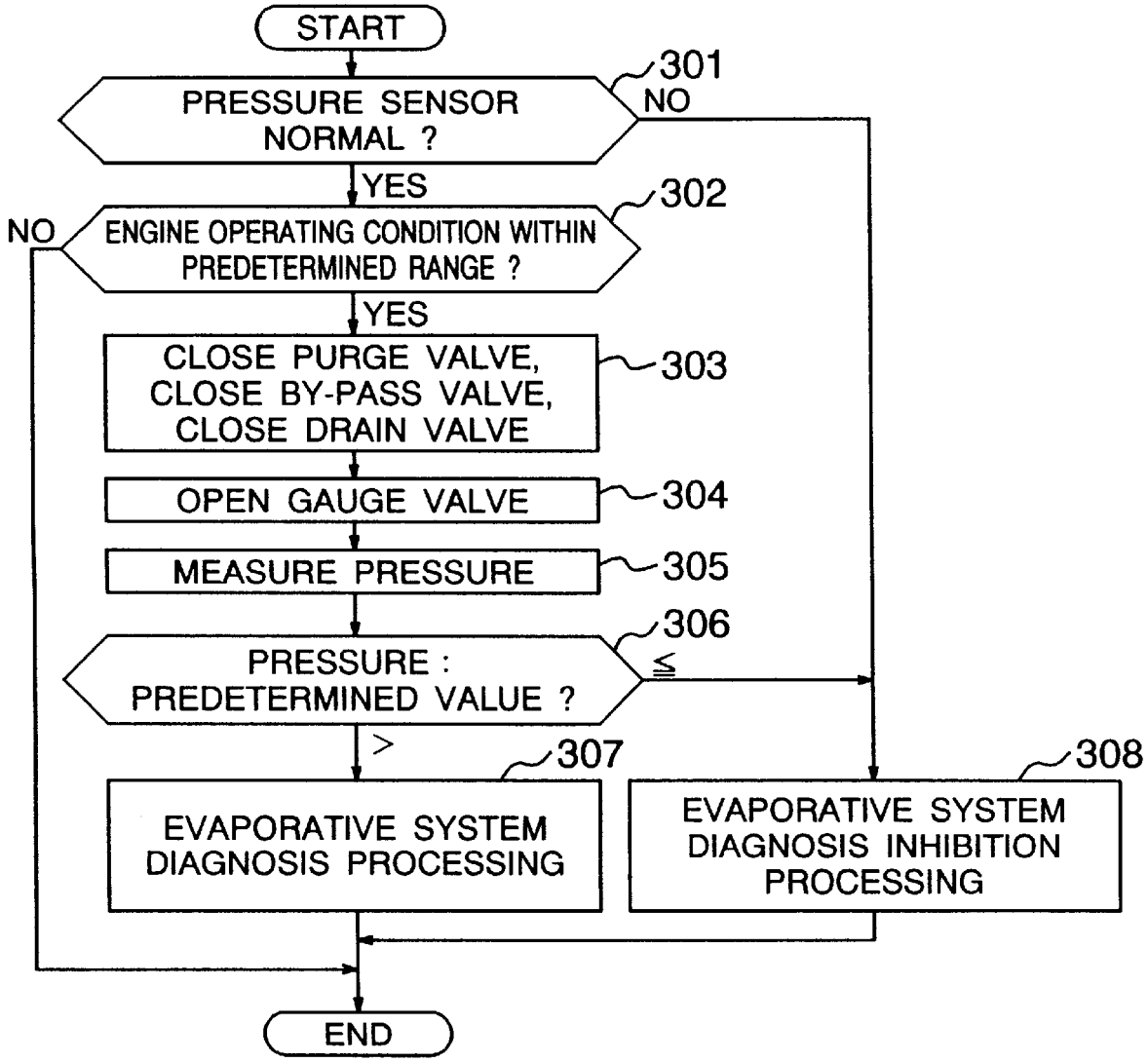
FIG. 13 is a flow chart showing a process for the diagnosis of the clogging of an air cleaner.

As one example, explanation will be made of the occasion when the air cleaner 1, provided in the intake system of the engine, is clogged. In the diagnosis method for the evaporative system 6, the gauge line 5 communicates with the downstream side of the air cleaner 1 so as to check a leakage. With this arrangement, the clogging of the gauge line by dirt or the like in the atmosphere is prevented, and also even if the gauge valve 17 fails while kept in its open condition, the evaporative gas will not be discharged to the atmosphere, but can be burned in the engine. In order to detect a leakage in the evaporative system 6, the gauge line 5 must lead to a place kept under atmospheric pressure. However, when the air cleaner 1 becomes clogged, the pressure in the intake tube, disposed downstream of the air cleaner, is made negative by a resistance to the flow through the air cleaner 1, which leads to a possibility that the accurate diagnosis can not be effected. Therefore, when the air cleaner 1 is clogged, the inhibition of the diagnosis and the correction of the diagnosis result becomes necessary. One example of such an operation method will be described with reference to a control flow chart of FIG. 13.

First, it is judged whether or not the pressure sensor (pressure detection means) 11, provided in the evaporative system, is normal (step 301). The method of checking the pressure sensor 11 is performed by checking an electrical connection (function) of a sensor output signal line (that is, detecting a short-circuit or the breaking of a wire), or by checking the performance by comparison with the pressure in the intake tube of the engine under a predetermined operating condition (that is, a value detected by a sensor for detecting the pressure in the intake tube, or a value corresponding to the pressure in the intake tube, which is obtained using at least two of engine condition parameters including the amount of intake air into the engine, the engine speed, the intake air temperature, and the degree of opening of a throttle), or by checking an output obtained when a sensing portion of the sensor (if it is a relative pressure sensor) in the evaporative system is subjected to a predetermined pressure (usually the atmospheric pressure or a negative pressure in the engine technology). If the pressure sensor is abnormal, the program proceeds to an evaporative system diagnosis inhibition processing (Step 308), and a processing for preventing an erroneous diagnosis due to the abnormal condition of the pressure sensor 11, or a processing for dealing with a rebound due to the abnormal condition of the pressure sensor 11 is executed.

If the pressure sensor 11 is normal, it is checked whether or not the engine operating condition is in a range suited for judging the clogged condition of the air cleaner 1 (Step 302). The engine operating range is judged from the magnitude and the amount of change of engine condition parameters including the engine load, the rotational speed, and the degree of opening of the throttle. If it is judged that the engine operating range is suited for checking the clogging of the air cleaner 1, the valves in the evaporative system are operated for judging the clogged condition of the air cleaner 1 (Step 303). First, the purge valve 4 is closed, and then the by-pass valve 15 is closed, and then the drain valve 10 is closed, so that the interior of the evaporative system 6 is sealed in a condition of the atmospheric pressure. Waiting times between the operations of the valves differ depending on the operating condition and the construction of the engine and the evaporative system 6. Then, the gauge valve 17 is opened in Step 304, and the pressure in the evaporative system is measured in Step 305. With respect to this pressure measurement, the magnitude of the pressure or the amount of change of the pressure is detected for a predetermined time period after the gauge valve 17 is opened. Then, in Step 306, the measured pressure is compared with a predetermined value, thereby judging the clogged condition of the air cleaner 1. If the measured pressure is larger than the predetermined value, the air cleaner 1 is not clogged, and judging that the diagnosis of the evaporative system can be effected properly, an evaporative system diagnosis processing is executed in Step 307. If the measured pressure is smaller than the predetermined value, it is judged that the air cleaner is in a clogged condition, and an evaporative system diagnosis inhibition processing (the countermeasures for a rebound or a warning of the abnormal condition) is executed in Step 308.

Figure 14:
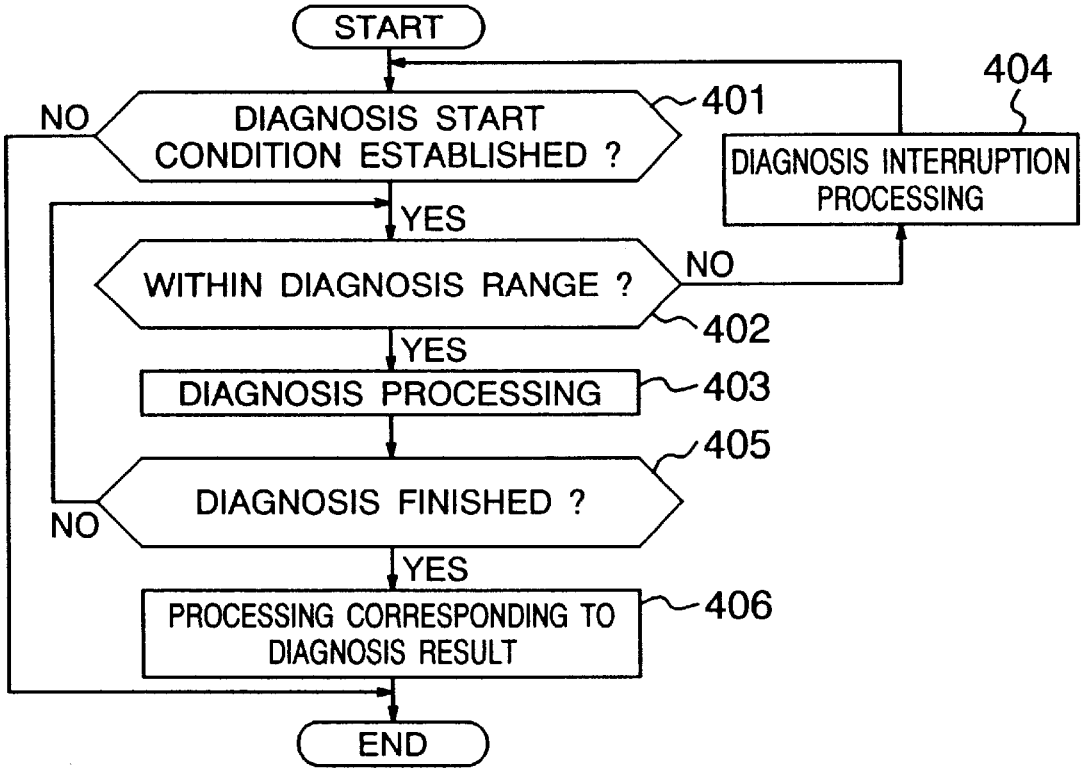
FIG. 14 is a flow chart showing a process of starting and interrupting a diagnosis.

In those conditions other than the operating condition suited for the diagnosis of the evaporative system, the diagnosis is inhibited or interrupted in order to prevent an erroneous diagnosis, and this method will be described. For example, in a transient condition in which the operating condition is abruptly changing, the production of the evaporative gas is promoted by vibrations of the vehicle, and the pressure in the evaporative system abruptly rises, so that the diagnosis may not be effected properly. Therefore, it is necessary to always monitor the operating condition so as to determine whether or not it is suited for the diagnosis. Also, when the valves of the evaporative system 6 do not operate properly, the accurate diagnosis is adversely affected. FIG. 14 is a flow chart explaining one example thereof.

When the leakage diagnosis is to be started, it is judged whether or not the condition is suited for the diagnosis (Step 401). Here, in addition to whether or not the operating condition is suited for the diagnosis, for example, whether or not actuators of the valves and others in the evaporative system and others, which are necessary for the diagnosis, can operate properly, a whether or not the sensors necessary for the diagnosis have a proper range of performance, and whether or not the environment, in which the vehicle is used, or the engine condition causes the evaporative gas to be produced in a large amount, are judged. Parameters, used for judging whether or not the operating condition is suited for the diagnosis, include the speed of the vehicle, the acceleration of the vehicle, the degree of opening of the throttle, the degree of opening of an accelerator, the engine speed, the amount of intake air, the engine load, the pressure in the intake tube (that is, a value detected by a sensor for detecting the pressure in the intake tube, or a value corresponding to the pressure in the intake tube, which is obtained using at least two of engine condition parameters including the amount of intake air into the engine, the engine speed, the intake air temperature, and the degree of opening of the throttle), and the amount of injection of the fuel (pulse width of the fuel injection in an injection system). At least one of these parameters is used. The judgment is made by determining whether the magnitude or the change amount (change rate) of such parameter is in a predetermined range. The valves required for the diagnosis of the evaporative system 6 include the purge valve 4, the drain valve 10, the gauge valve 17, the by-pass valve 15 and the check valve 16. The sensors required for the diagnosis of the evaporative system include the sensor 11 for detecting the pressure in the evaporative system. For judging the environment, in which the vehicle is used, or the engine condition, the fuel temperature, the remaining fuel amount, the atmospheric pressure, the outside air temperature, the intake air temperature, an engine coolant temperature, and an engine oil temperature can be used. For example, when the outside air temperature is low, a sealing performance of the valves is lowered, and this adversely affects the diagnosis. These are suitably selected and checked suitable according to the need, and if it is judged that the condition is suited for the diagnosis, the initiation of the diagnosis is permitted (Steps 402 and 403), so that the diagnosis processing is started. In Step 402, those conditions (particularly, the transient condition in which the operating condition is abruptly changing as described for Step 401), which adversely affect the diagnosis, are always monitored during the diagnosis operation (from the start of the diagnosis to the end of the diagnosis), and if it is judged that the condition, adversely affecting the diagnosis, occurs, or that the operating condition becomes out of the proper range, a diagnosis interruption processing of Step 404 is executed. Here, not only the interruption of the diagnosis and the discarding of measurement data for the diagnosis at this time are effected, but also the selection of effective data used for a subsequent diagnosis and the storing of such data into a memory can be effected. By reusing the effective data in the subsequent diagnosis, it is expected that the diagnosis time is shortened and that the diagnosis precision is enhanced. In Step 402, one or more suitable judgment condition parameters are selected among those similar to the parameters in Step 401. For example, these parameters include the speed of the vehicle, the acceleration of the vehicle, the degree of opening of the throttle, the degree of opening of the accelerator, the engine speed, the amount of intake air, the pressure in the intake tube (that is, a value detected by a sensor for detecting the pressure in the intake tube, or a value corresponding to the pressure in the intake tube, which is obtained using at least two of engine condition parameters including the amount of intake air into the engine, the engine speed, the intake air temperature, and the degree of opening of the throttle), the engine load, the amount of injection of the fuel (pulse width of the fuel injection in an injection system), and the fuel temperature. This judgment is made by determining whether the magnitude or the change amount (change rate) of such parameter is in a predetermined range. If the interruption of the diagnosis is not decided in Step 402, and the diagnosis is continued in Step 403, and the finish of the diagnosis is judged in Step 406, and then a processing, corresponding to the diagnosis is executed in Step 406. Here, examples of the processing, corresponding to the diagnosis result, include the processing of giving a warning to the operator when detecting a failure of the evaporative system, the storing (memorizing) of a failure code, the operating condition at the time of detection of a failure, and the control of the engine in accordance with the failure condition of the evaporative system.

Figure 15:
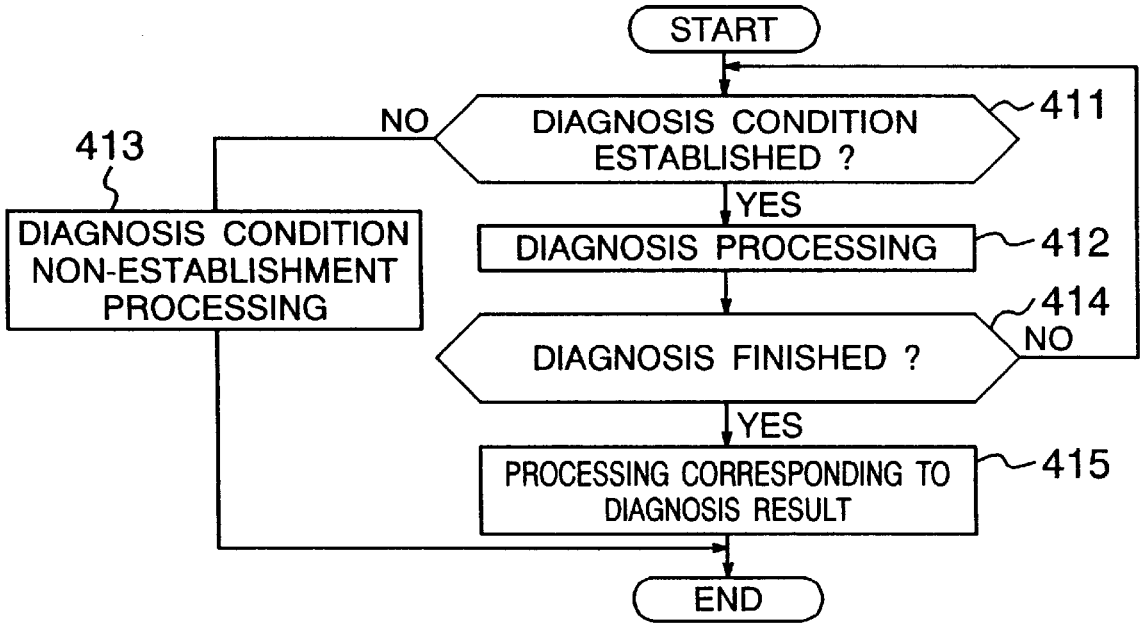
FIG. 15 is a flow chart showing a process of starting and interrupting a diagnosis.

FIG. 15 is a flow chart of a method of inhibiting or interrupting the diagnosis of the evaporative system in those conditions other than the operating condition, suited for the diagnosis of the evaporative system, in order to prevent an erroneous diagnosis, as described in FIG. 14, and in this method, Step 401 and step 402 are combined into Step 411 in which a single judgment condition establishment judgment processing is effected. In this method, until Step 414 in which it is judged whether or not the diagnosis processing (Step 412) is finished, the condition is always monitored so as to determine whether or not the diagnosis can be effected properly. In Step 411, one or more suitable parameters are selected among those similar to the judgment parameters, used in Step 401, depending on the type of the vehicle and the evaporative system 6. A processing (Step 413) to be effected when the diagnosis condition is not met or established is almost similar to the diagnosis interruption processing (Step 404 of FIG. 14), and a processing (Step 415) in accordance with the diagnosis result is almost similar to the processing (Step 406 of FIG. 14) in accordance with the diagnosis result.

Next, explanation will be made of a method of inhibiting the diagnosis of the evaporative system when the gauge system, including the gauge valve 17 and the gauge orifice 19, is abnormal.

When an abnormal condition is encountered in the gauge system including the gauge valve 17 and the gauge orifice 19, a diagnosis error of the evaporative system 6 is large, and therefore the diagnosis is inhibited.

Figure 16:
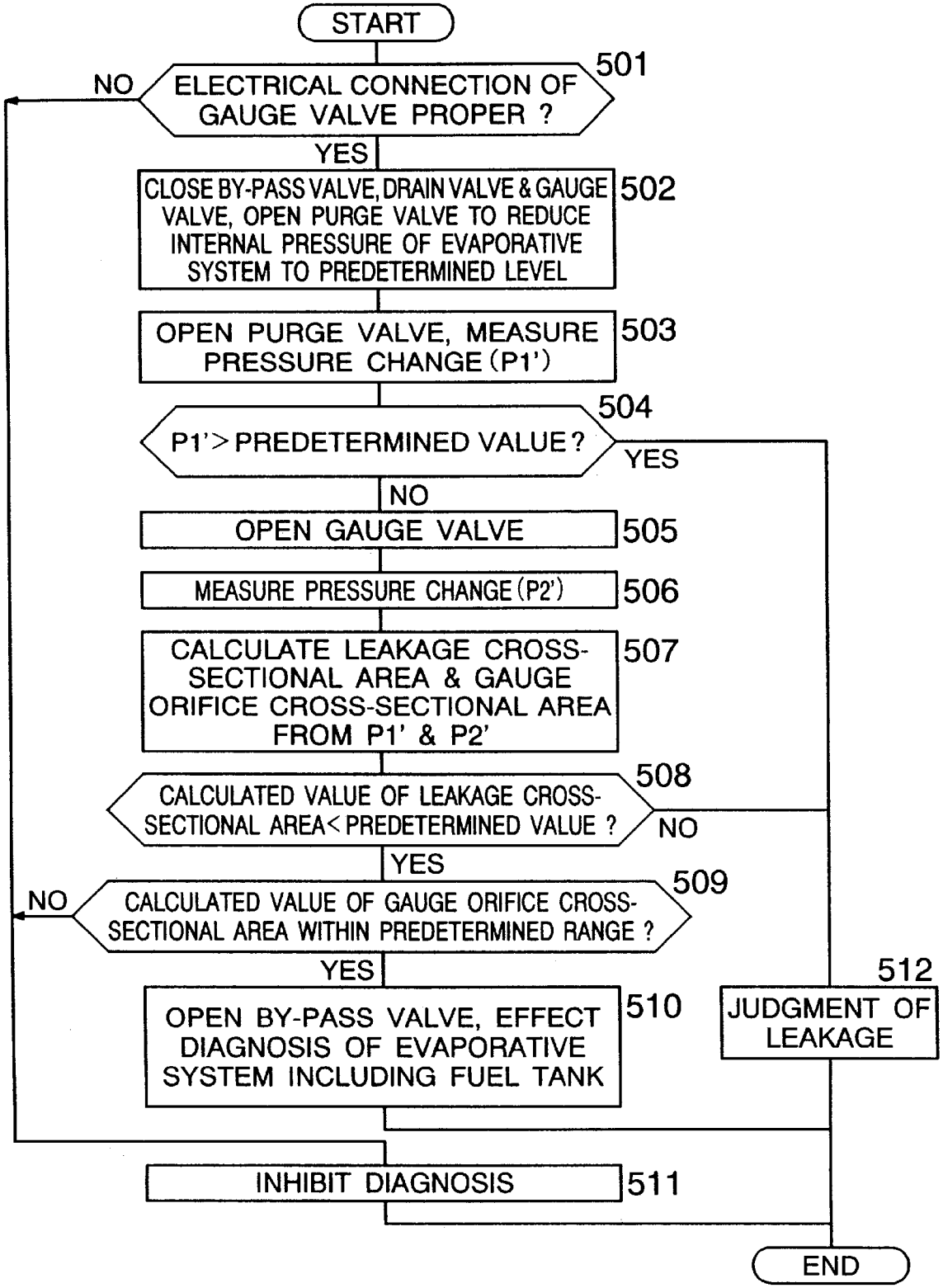
FIG. 16 is a flow chart showing a process for the diagnosis of a gauge system.
Figure 17:
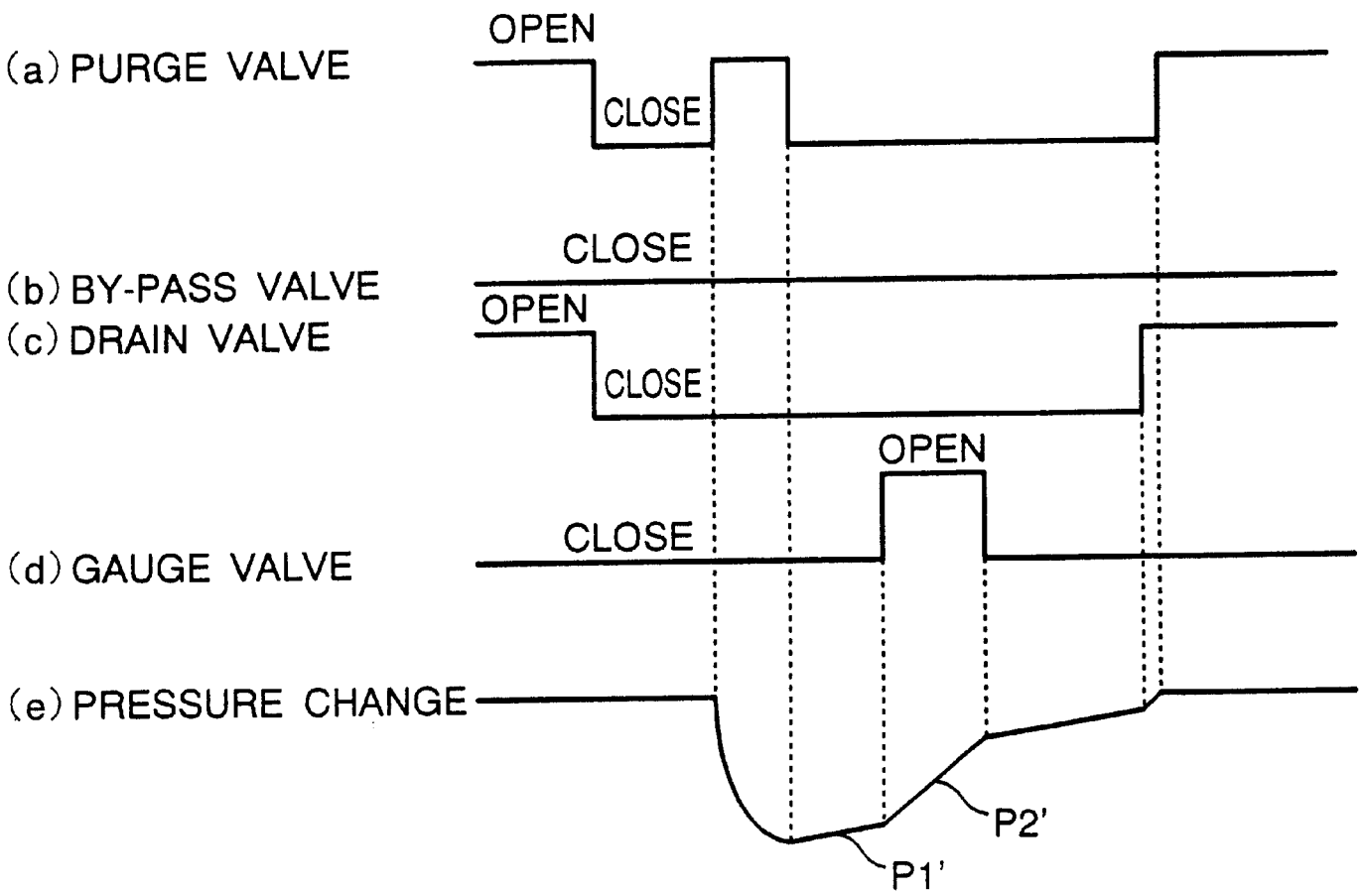
FIG. 17 is a diagram showing operating timings of the valves and a pressure change for the diagnosis of the gauge system.

FIG. 16 shows one example of an diagnosis inhibiting process. When it is judged in Step 501 that the electrical connection of the control system including the gauge valve 17 and the ECU12 is abnormal, the diagnosis of the evaporative system 6 is inhibited in Step 511. If the electrical connection is normal, the by-pass valve 15, the drain valve 10 and the gauge valve 17 are closed, and the purge valve 4 is opened, thereby reducing the pressure in the evaporative system 6 to a predetermined value (−20 to −30 mmHg relative to the atmospheric pressure) in Step 502. Then, the purge valve 4 is closed, and a pressure change P1' is measured by the pressure sensor 11 (Step 503). If it is judged that the pressure change P1' is greater than a predetermined value (Step 504), it is judged that there exists a leakage in the evaporative system 6 (Step 512). If it is judged in Step 504 that the pressure change P1' is smaller than the predetermined value, the gauge valve 17 is opened in Step 505, and a pressure change P2' is measured. This process is shown in FIG. 17. The purge valve 4, the by-pass valve 15, the drain valve 10 and the gauge valve 17 are operated as indicated by (a), (b), (c) and (d) in FIG. 17, and the values P1' and P2' of the pressure change (e) are measured. In Step 507 of FIG. 16, using the values P1' and P2' of the pressure change (e), a cross-sectional area of leakage of the evaporated fuel (evaporative gas) residing in the evaporative system is calculated, and also the cross-sectional area Ag of the gauge orifice 19 is calculated. The estimated value of Ag can be calculated, for example, from the following formula:

$$Ag=K(P2'/\sqrt{P2}-P1'/\sqrt{P1}) \quad (4)$$

where K represents a value determined by the volume of the canister 8, the density of the atmosphere, or other. If it is judged in Step 508 that the cross-sectional area of the leakage is more than a predetermined value, it is judged in Step 512 that the leakage, corresponding to a hole diameter more than the predetermined value, exists in the evaporative system 6. If it is judged in Step 508 that the calculated value of the leakage cross-sectional area is less than the predetermined value, it is judged in Step 509 whether or not the calculated cross-sectional area of the gauge orifice is in a predetermined range, and if this calculated value is in this predetermined range, the program proceeds to the next Step 510 for effecting the diagnosis. If it is judged in Step 509 that the calculated value of the cross-sectional area of the gauge orifice is more than or less than the predetermined range, the diagnosis of the evaporative system 6 is inhibited in Step 511.

In the present invention, although the precision of the cross-sectional area Ag of the gauge orifice 19 is important, it is necessary that Ag should be larger than a cross-sectional area AP of the most constricted portion in the line (communicating with the point downstream of the air cleaner 1 or with the atmosphere) including the gauge line 5, the purge line 7 and the evaporative gas line 20. Preferably, Ag is at least three times larger than Ap. The reason for this will de described below. An actual effective cross-sectional area Ae, obtained when the gauge valve 17 is opened, is expressed by the following formula:

$$Ae=AgAp/\sqrt{(Ag^2+Ap^2)} \therefore Ae/Ag=1/\sqrt{(1+(1/(Ap/Ag))^2)} \quad (5)$$

Figure 18:
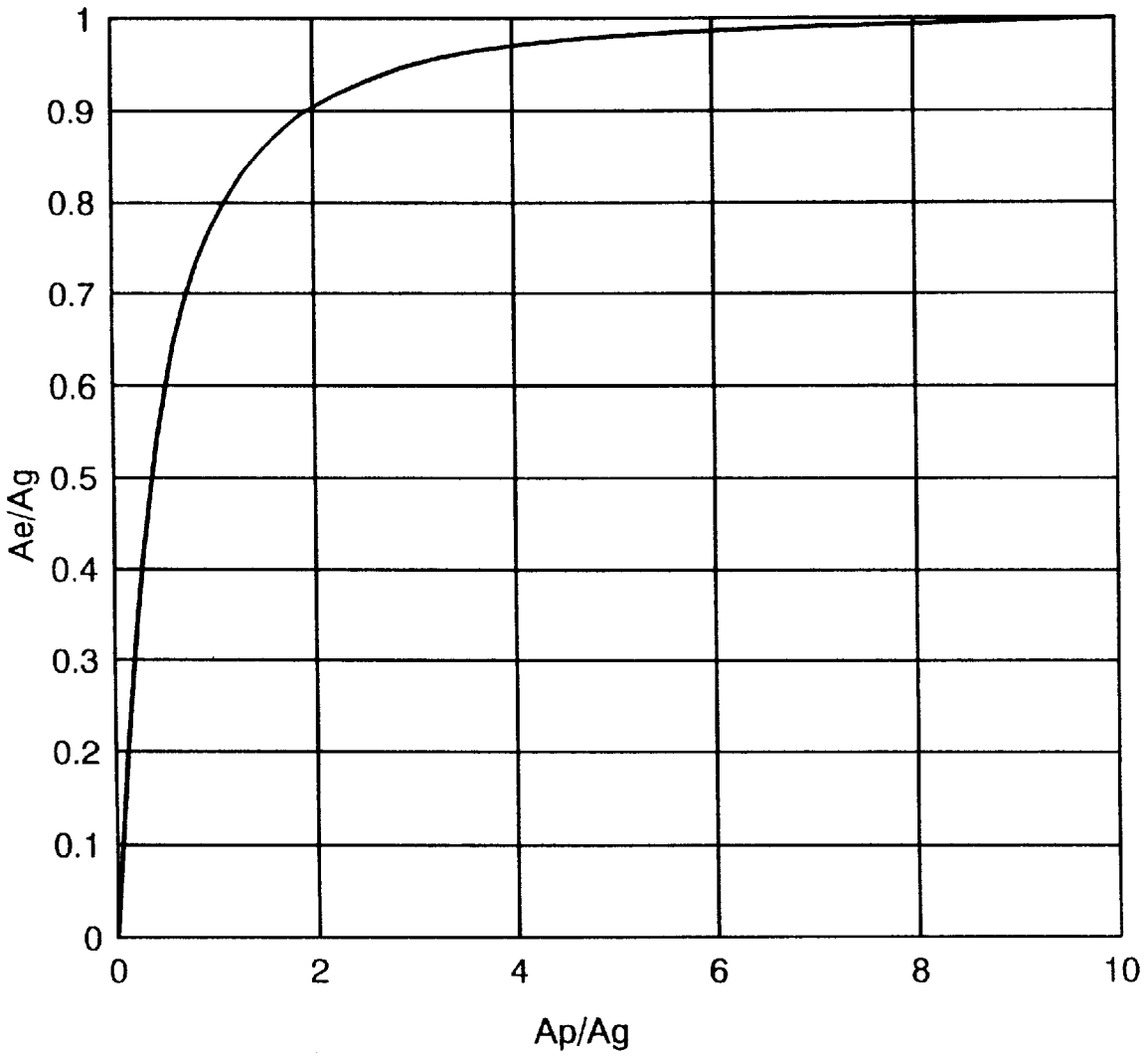
FIG. 18 is a diagram showing the relationship of a cross-sectional area Bag of a gauge orifice, a cross-sectional area Ap of the line (piping) and an effective cross-sectional area Ae thereof.

The relation of the formula 5 is shown in FIG. 18. Ap, representing the cross-sectional area of the most constricted portion of the line, is varied from one construction to another, and therefore Ae/Ag need to be stable relative to a change of Ap. It is preferred that the leakage judgment precision should be achieved only by controlling the precision of the cross-sectional area Ag of the gauge orifice 19, and Ae=Ag is preferred. Therefore, it is preferred that Ap/Ag be larger. Specifically, in order that the precision required for Ap can be made not more than a half of the precision required for Ag, at least Ap/Ag>1, that is, Ap>Ag, need to be established (Ap>Ag is necessary in order that the influence on Ae, developing when Ap varies, for example, 10%, can be made equal to the influence on Ae developing when Ag varies 5%). More preferably, Ap is not less than three times larger than Ag, so that the required precision for Ap can be made not more than 1/10 of the required precision for Ag, and therefore Ae can be kept to within an error range of about 5% relative to Ag. Incidentally, if there are many constricted portions in the line, it is necessary to consider the combined flow area of Ap. For example, if there are two constricted portions each having a diameter of about 3 mm, it is necessary to consider that Ap should have a diameter of 2.5 mm. Furthermore, if the canister 8 or other has a larger flow resistance, it is necessary that the equivalent Ap should be calculated, and that Ap>Ag should be established as described above.

With respect to the diagnosis of the evaporative system, using a correction amount (in this embodiment, this will be explained by way of a correction factor a representing a correction amount of an air-fuel ratio feedback control in the calculation of the fuel) in the engine air-fuel ratio feedback control, a rebound to the exhaust gas at the time of the diagnosis is suppressed to a minimum (that is, the discharge of harmful components of the exhaust gas is suppressed) by selecting or varying a pull-down control amount (the stopping of the pull-down, the pull-down speed, and the target pressure achieved by the pull-down) in accordance with the correction factor a at the time of the diagnosis. This method and a method of finishing the diagnosis in a short time will now be described.

Figure 19:
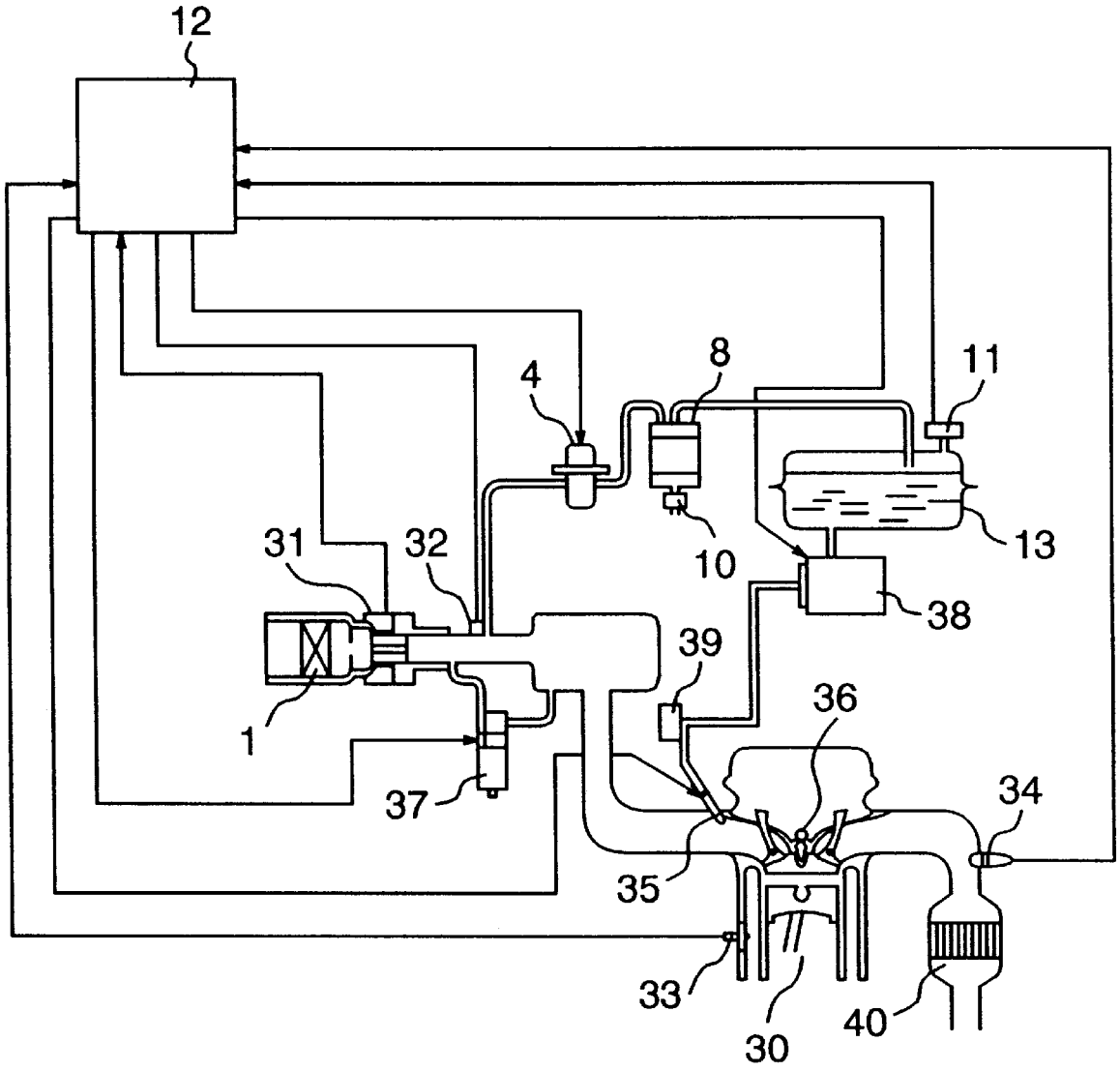
FIG. 19 is a view explanatory of an air-fuel ratio feedback control.

First, the air-fuel ratio feedback control will be described with reference to FIG. 19.

An air cleaner 1, an air flow sensor 31, a throttle opening sensor 32, a coolant temperature sensor 33, and an air-fuel ratio sensor 34 are provided on an engine body 30, and detected values of these sensors are inputted into ECU 12, and an fuel injection amount, an ignition control value, an idling speed control (ISC) value and so on are computed. With the fuel injection amount, the fuel is supplied by energizing an injector 35 by a fuel injection pulse width signal, and with the ignition control output value, the ignition is made at the optimum timing by a spark plug 36, and the ISC control amount is outputted to an ISC control valve 39 so as to supply an optimum amount of auxiliary air. Further, there are provided a fuel pump 38 for pressurizing the fuel to be supplied to the injector 35, and a fuel pressure control valve 39 for adjusting the pressure of this pressurized fuel.

The fuel, injected from the injector 35, forms, together with the intake air, an air-fuel mixture, and flows into a cylinder of the engine, and is exploded and burned by ignition during the compression caused by a reciprocating motion of a piston, and exhaust gas is discharged to an exhaust pipe. This exhaust gas is promoted in oxidation-reduction by a catalyst 40 provided in the exhaust pipe, so that harmful exhaust gas components, including HC, CO and NOx, are purified. In order to achieve the maximum purifying efficiency of the catalyst 40, this system is provided with an-air-fuel ratio feedback system (controlled by the ECU 12) for feedback-controlling the air-fuel mixture ratio in accordance with the output of the air-fuel ratio sensor 34 in such a manner that the mixture ratio becomes thick and lean alternately in the vicinity of a theoretical air-fuel ratio.

At the time of the diagnosis of the evaporative system 6, when the interior of the evaporative system 6 is brought into a negative pressure by the pull-down, the production of the evaporative gas is promoted in the fuel tank 13, and a large amount of the evaporative gas is fed into the intake tube, so that the above air-fuel ratio feedback control can not follow, and the control air-fuel ratio becomes out of agreement with theoretical air-fuel ratio, and as a result it is possible that the exhaust gas, as well as the operating ability, is worsened. A method of suppressing the worsening of the exhaust gas and the operating ability will be now be described with reference to FIGS. 20 to 24.

Figure 20:
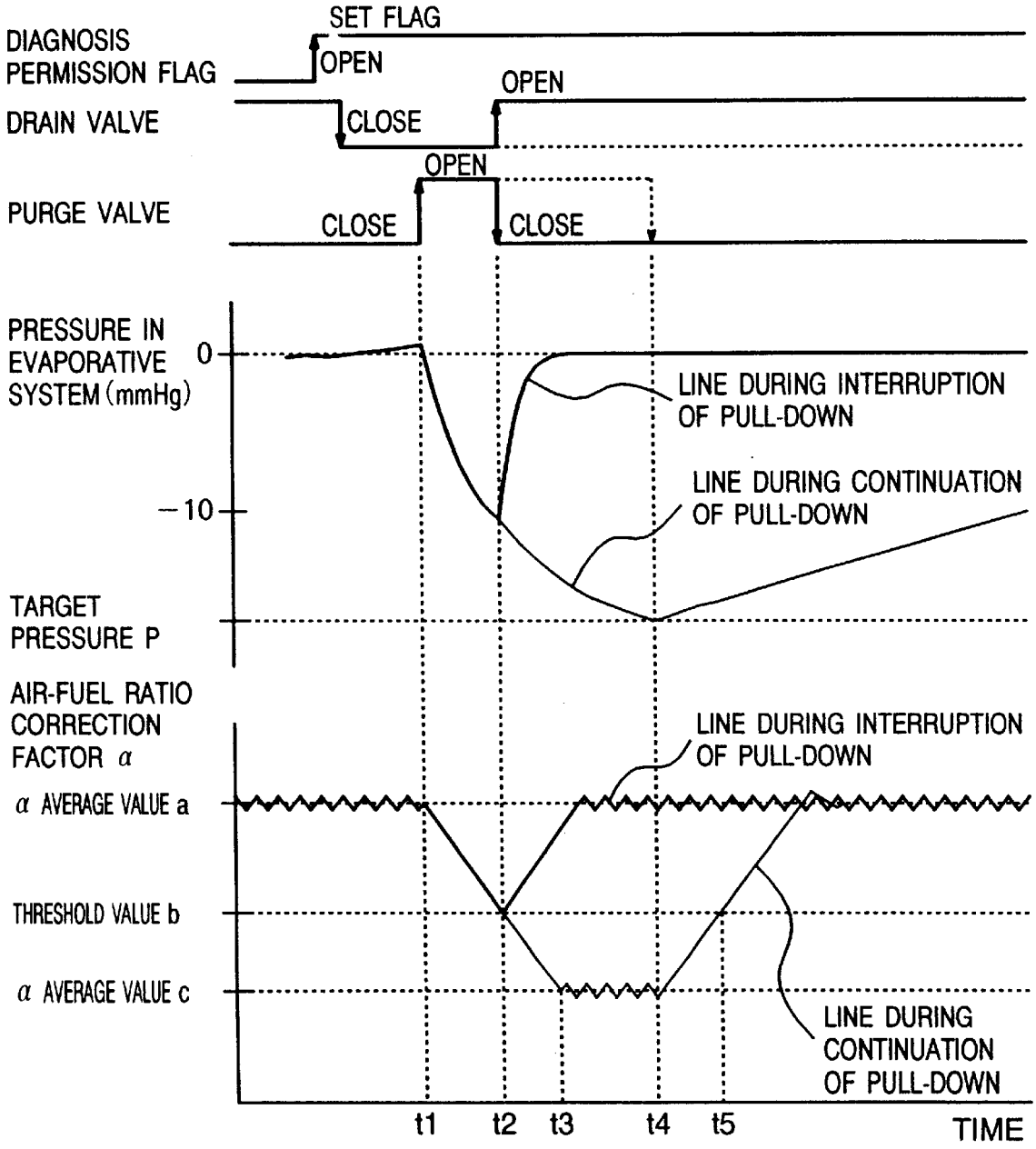
FIG. 20 is a diagram showing a method of interrupting a pull-down, as well as its effect.

FIG. 20 is a timing chart explaining a method in which by detecting the amount of change of the air-fuel ratio feedback correction factor a (hereinafter referred to as "air-fuel ratio correction factor α") calculated in accordance with the output of the air-fuel sensor 34 mounted in the exhaust tube, it is judged whether or not an excessive amount of evaporative gas is discharged or fed into the engine 30 at the time of the pull-down, and if an excessive amount of evaporative gas is discharged, the diagnosis is interrupted, thereby suppressing the worsening of the exhaust gas. If the diagnosis is not interrupted, but is continued when an excessive amount of evaporative gas is discharged into the engine, the exhaust gas, as well as the operating ability (caused by a torque variation due to a variation of the combustion), is worsened in accordance with a step (difference) of the air-fuel ratio due to the discharged evaporative gas.

At time t1, the purge valve 4 is opened to start the pull-down, but at time t2, the air-fuel ratio correction factor a reaches a threshold value b, and therefore the purge valve 4 is closed, thereby interrupting the pull-down. The air-fuel ratio step (difference) at this time is a step from α average value a (the average value of a at time t1) to the threshold value b of α (the value of a at time t2). If the diagnosis is continued even after the air-fuel ratio correction factor a reaches the threshold value b at time t2, the air-fuel ratio step is a step from a average value c (the average value of α at time t3) at time t3 (at which the air-fuel ratio feedback can follow) to α average value a (the average value of α at time t1), and clearly the exhaust gas becomes worse as compared with when the diagnosis is interrupted.

By opening the drain valve 10 simultaneously when closing the purge valve 4, the interior of the evaporative system 6 is increased from a negative pressure to a level near to the atmospheric pressure, so that the production of an undue amount of evaporative gas in the fuel tank 13 can be prevented.

Figure 21:
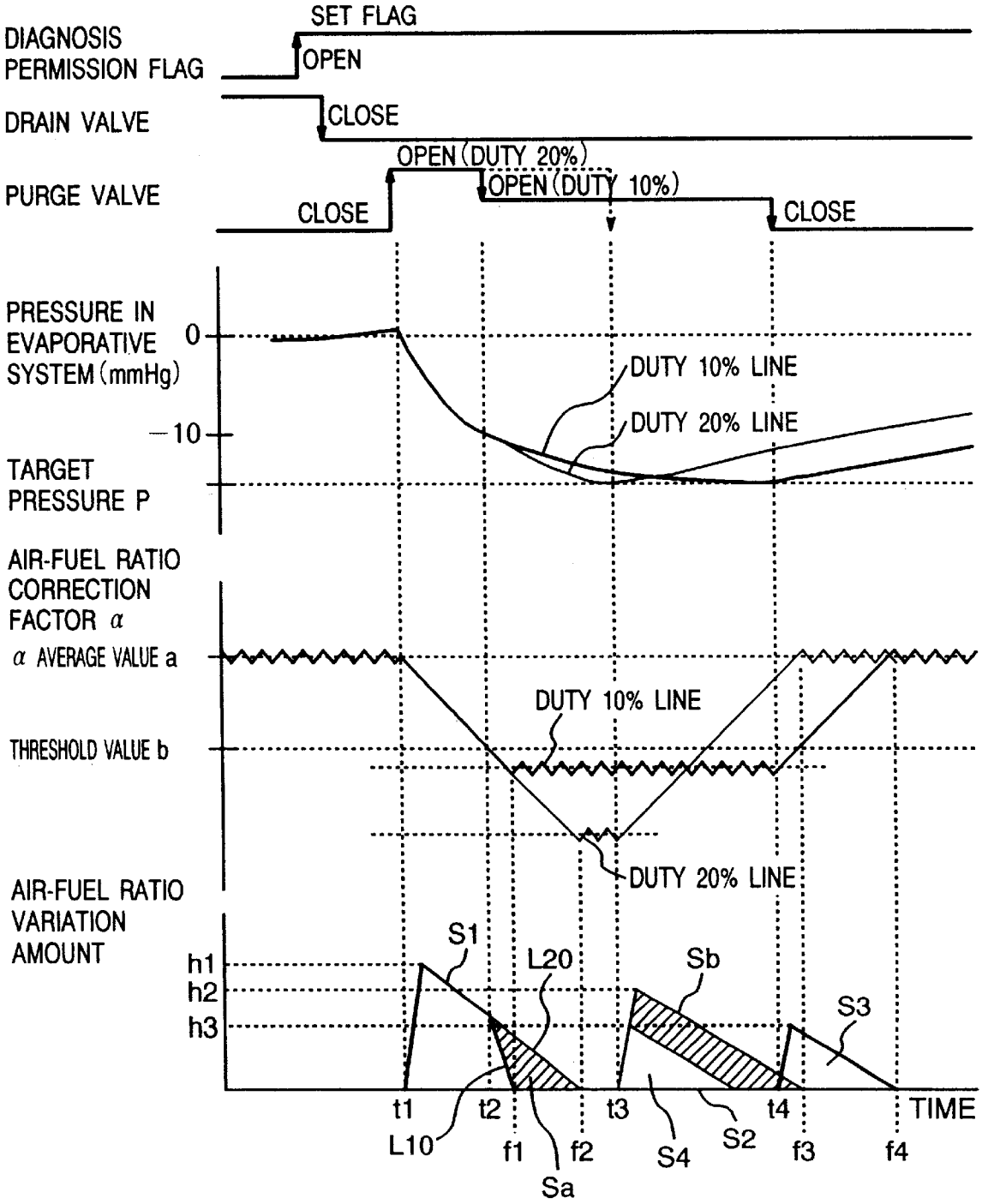
FIG. 21 is a diagram showing a method of changing the pull-down speed, as well as its effect.

With reference to FIG. 21, explanation will be made of a method in which when an excessive amount of evaporative gas is discharged into the engine 30 at the time of pull-down, this is detected by the air-fuel ratio correction factor α, and if an excessive amount of evaporative gas is discharged, the pull-down speed or rate is changed so as to enhance the followability of the air-fuel ratio feedback control, thereby suppressing the worsening of the exhaust performance and the operating ability to a minimum.

At time t2, when the air-fuel ratio correction factor α reaches a threshold value b, it is judged that an excessive amount of evaporative gas is discharged, and for example if the purge valve 4 is a duty control valve of the solenoid type, its duty is changed, so that an opening area of the purge valve 4 is reduced, thereby reducing the pull-down speed (the speed of decrease of the pressure). In the case of a control valve of the stepping motor-type, this valve is controlled by energizing a pulse so that its opening area can be reduced.

The improved exhaust by this method will be described with reference to the area change of the air-fuel ratio variation amount in FIG. 21. In an air-fuel ratio variation area S1, the pull-down speed is reduced (in FIG. 21, the valve control duty is reduced from 20% to 10%) at time t2 when the air-fuel ratio correction factor α reaches a threshold value b, thereby enhancing the followability of the air-fuel ratio control, so that the exhaust is improved by an amount of a hatched portion Sa representing an air-fuel ratio variation area. A line L10 indicates a condition in which the amount of flow of the evaporative gas into the engine is reduced by reducing the valve control duty to 10%, so that the followability of the air-fuel ratio control is enhanced, and the air-fuel ratio variation is decreased rapidly.

The difference between a height h2 of an air-fuel ratio variation area S2, obtained when the purge valve 4 with a valve control duty of 20% is closed at time t3, and a height h3 of an air-fuel ratio variation area S3, obtained when the purge valve 4 with a valve control duty of 10% is closed at time t4, is due to the difference in the magnitude of the air-fuel ratio variation developing when abruptly stopping the discharge of the evaporative gas by closing the purge valve 4, and this variation magnitude difference is caused by the difference (between α average value d20 and α average value d10) in the amount of discharge of the evaporative gas, which is due to the difference (between the duty of 20% and the duty of 10%) in the amount of opening of the purge valve 4. The pull-down speed can be varied when the evaporative gas is produced, and by doing so, the air-fuel ratio variation, developing when the purge valve 4 is closed after the pull-down, can be suppressed, thereby improving the exhaust performance and the operating ability. The air-fuel ratio variation area S2 with the valve control duty of 20% and the air-fuel ratio variation area S3 with the valve control duty of 10% are produced at different times, respectively, and if the air-fuel ratio variation area S3 is produced at time t3 (as indicated by an air-fuel ratio variation area S4), the exhaust is improved by an amount of a hatched portion Sb which is the difference between the air-fuel ratio area S2 and the air-fuel ratio area S4.

Figure 22:
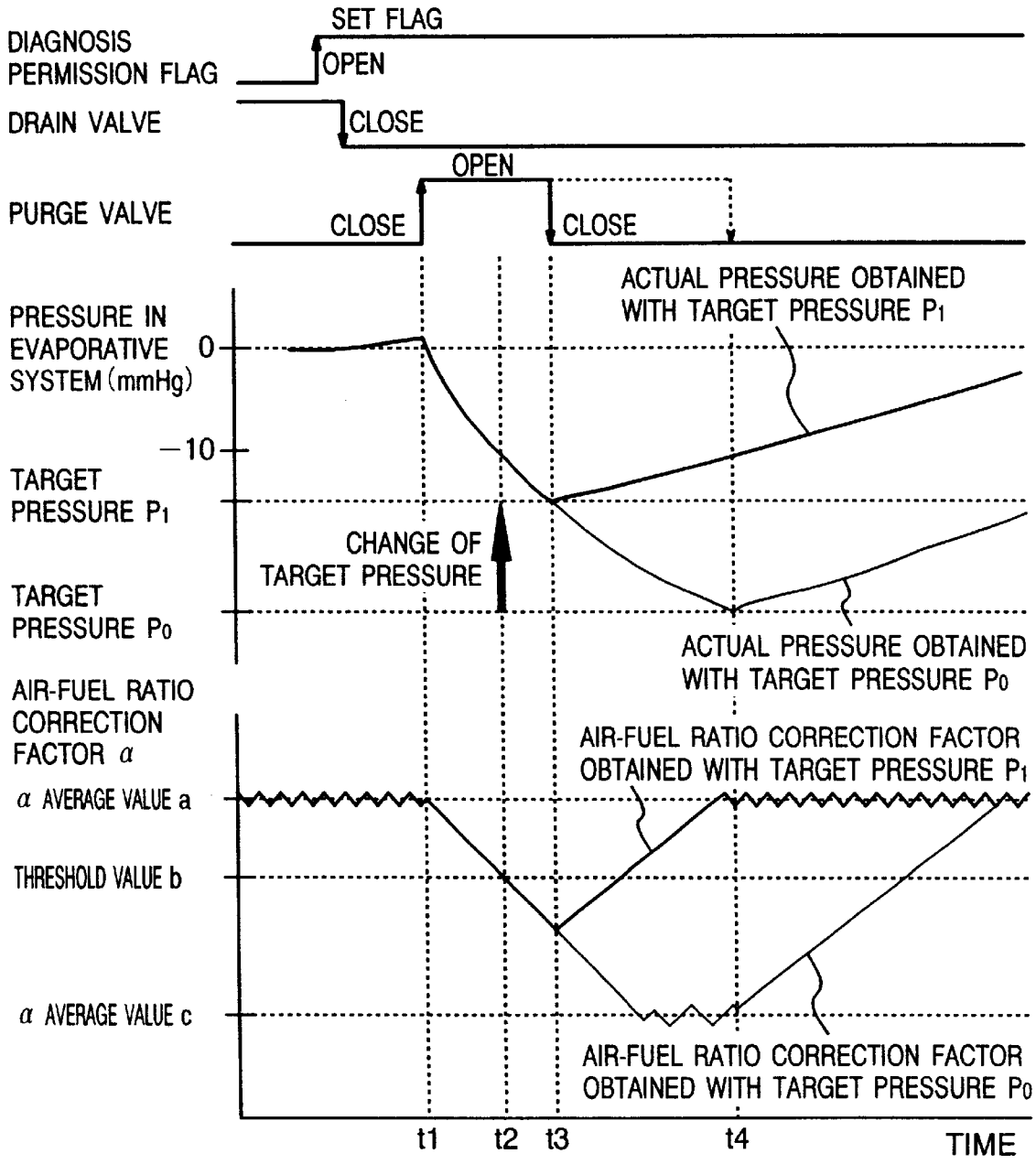
FIG. 22 is a diagram showing a method of changing a target pressure of the pull-down, as well as its effect.
Figure 23:
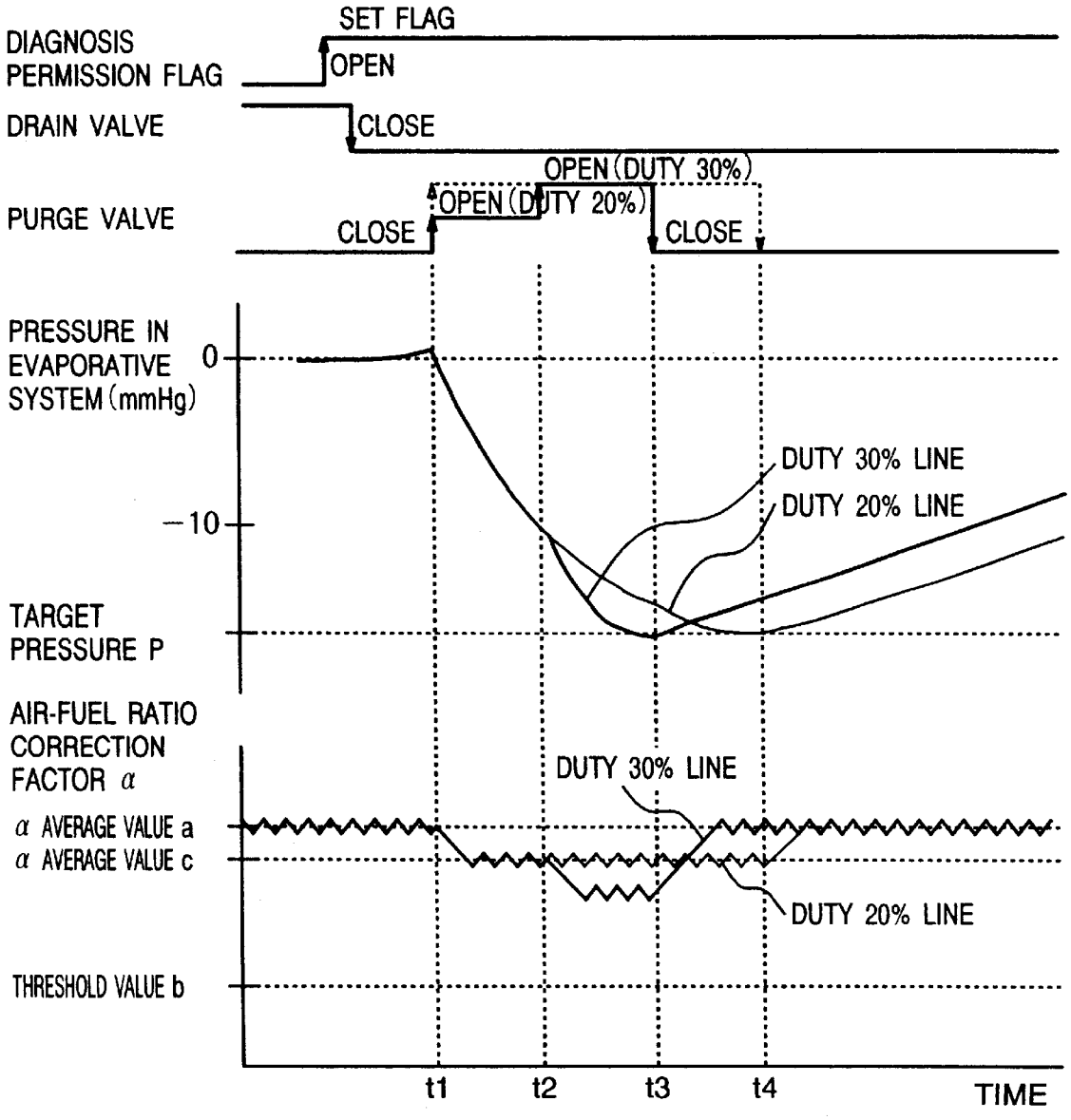
FIG. 23 is a diagram showing a method of changing the pull-down speed.

FIG. 22 is a diagram showing a method in which the discharge of an excessive amount of evaporative gas into the engine 30 at the time of the pull-down is detected by the air-fuel ratio correction factor α, and if an excessive amount of evaporative gas is discharged, the target pressure of the pull-down is changed so as to reduce the pull-down time, thereby suppressing the worsening of the exhaust performance and the operating ability to a minimum.

When the air-fuel ratio correction factor α reaches a threshold value b at time t2, it is judged that the evaporative gas is discharged in an excessive amount, and the target pressure of the pull-down is changed from a pressure P0 (the current target pressure) to a pressure P1, thereby reducing the pull-down time, and by doing so, the air-fuel ratio variation can be reduced, and the exhaust performance and the operating ability are improved.

At time t1, the purge valve 4 is opened to tart the pull-down, but since the air-fuel ratio correction factor a reaches the threshold value b at time t2, the target pressure is changed to P1, and the purge valve 4 is closed at time t2, thereby finishing the pull-down. An air-fuel ratio step at this time is smaller than an air-fuel ratio step (the difference between a, average value c and α average value a) obtained with the target pressure P0, and therefore the exhaust is improved by this amount.

The discharge of an excessive amount of evaporative gas into the engine 30 is detected by the air-fuel ratio factor a at the time of the pull-down as described above, and at this time, if the air-fuel ratio correction factor α does not reach a threshold value b (or is different more than a predetermined value from this threshold value) even a predetermined time period after starting the pull-down (for example, at time t2 in FIG. 23), it is judged that the amount of discharge of the evaporative gas into the engine 30 (which worsens the exhaust performance and the operating ability) is very small, and the pull-down speed is increased, thereby reducing the time period during which the exhaust and the operating ability are worsened. And besides, by thus reducing the time of the evaporative system diagnosis (that is, the time of the pull-down), the apparent evaporative system diagnosis possible range or region is increased (if the residence time in the diagnosis possible range is the same, the number of the diagnosis can be increased), and the evaporative system diagnosis can be effected rapidly and positively. The method of changing the pull-down speed is as described above for FIG. 21.

Figure 24:
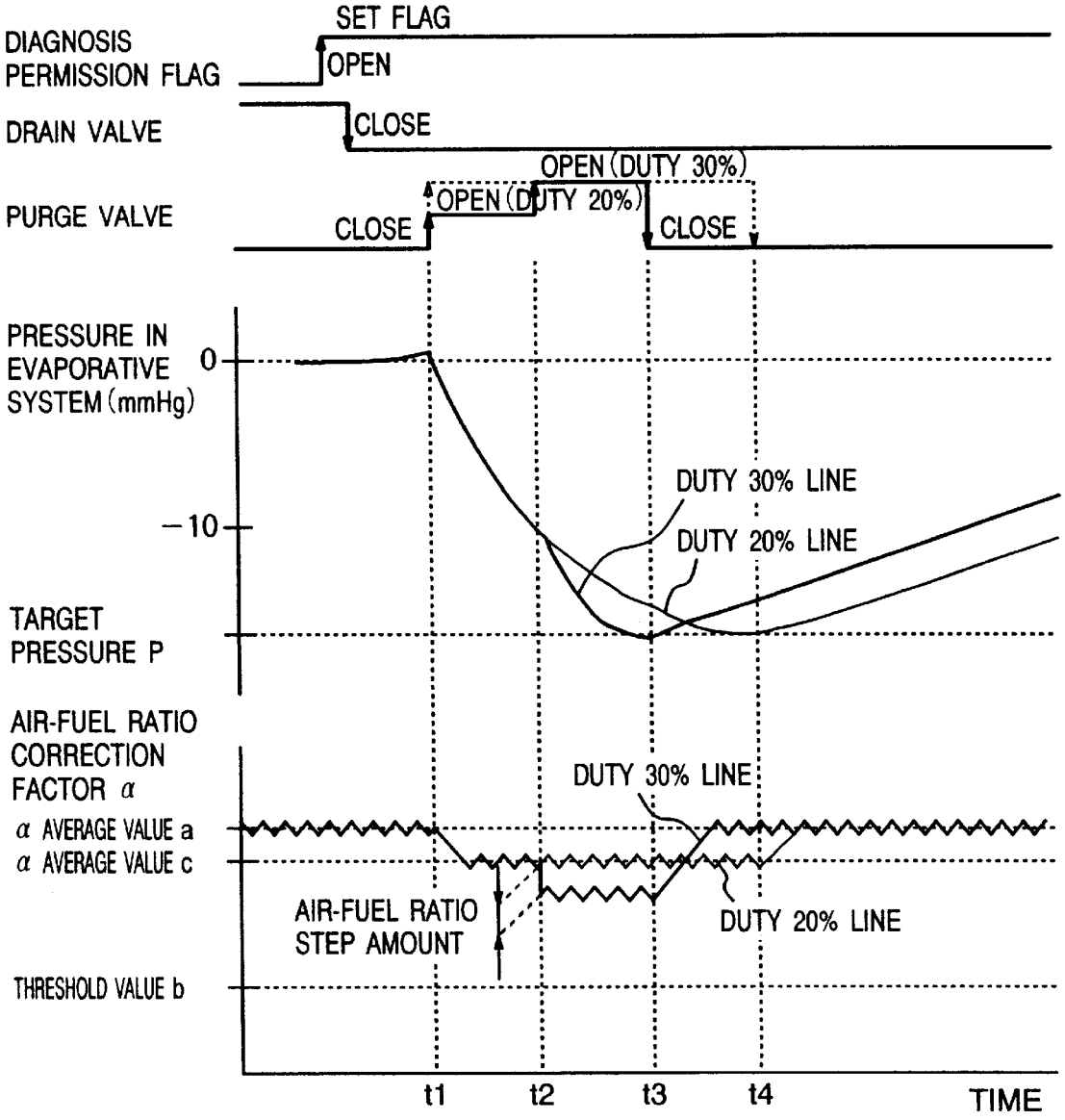
FIG. 24 is a diagram showing a method of changing the pull-down speed.

By reducing the air-fuel ratio correction factor α in a stepping manner simultaneously with the change of the opening area of the purge valve 4 when the pull-down speed is increased, the followability of the air-fuel ratio feedback control can be enhanced, thereby improving the exhaust performance. This method is shown in FIG. 24. For example, if the purge valve control duty is changed from 20% to 30% (see FIG. 24), the step amount of the air-fuel ratio correction factor α is represented (as the function of the valve control duty) by (α average value a −α average value c)*{(Q30−Q20)/Q20} where Q30 and Q20 represent values of the flow rate of the purge valves at the duty of 20% and the duty of 30%, respectively.

Figure 25:
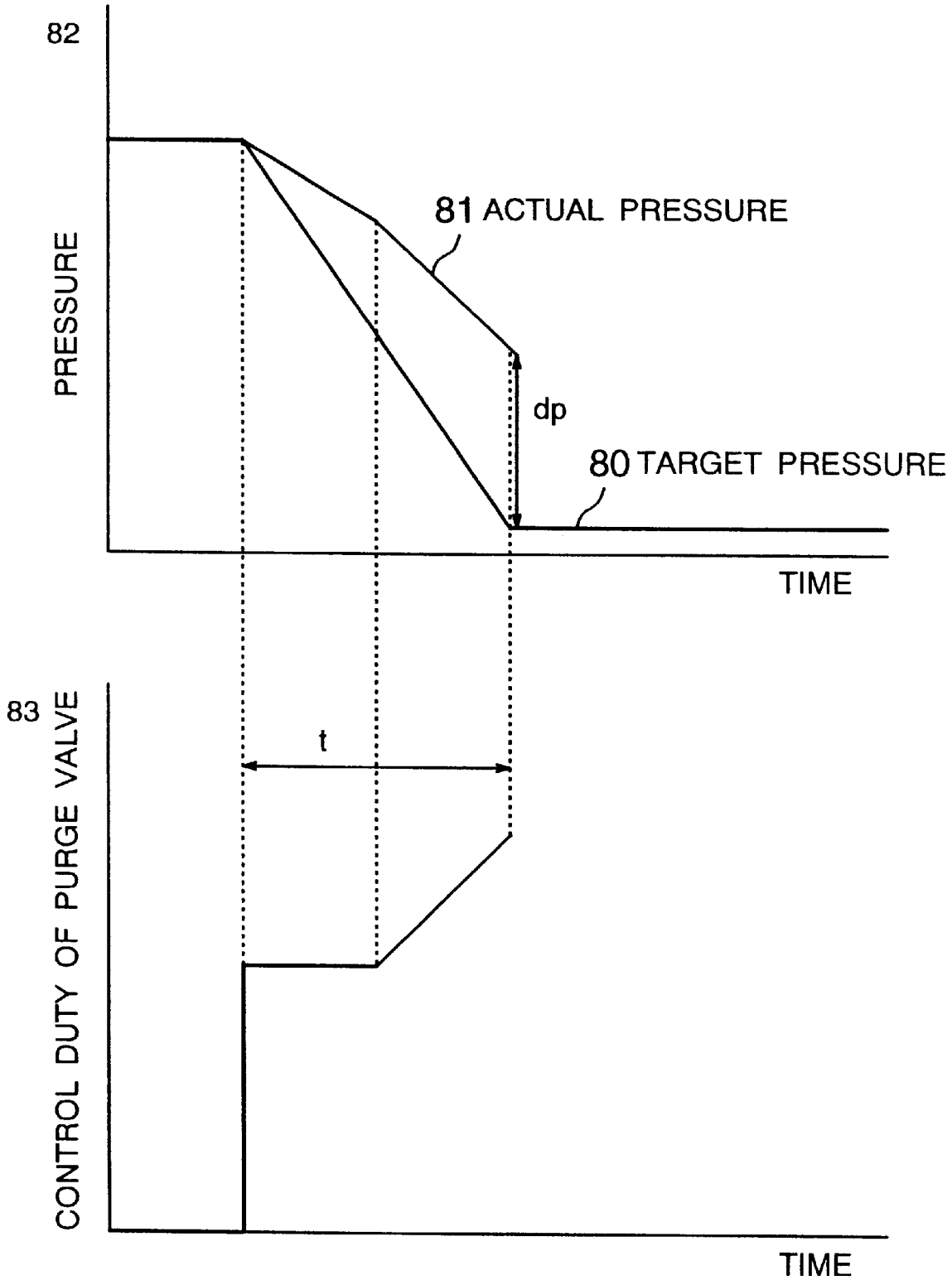
FIG. 25 a diagram showing a method of changing the pull-down speed, as well as a leakage diagnosis.

Next, explanation will be made of a method of effecting a diagnosis of the evaporative system 6 when the interior of the evaporative system 6 is made negative (−20 mmhg to −30 mmHg) relative to the atmospheric pressure (that is, pulled down) by opening the purge valve 4. FIG. 25 shows one example of a method of effecting the diagnosis of the evaporative system when the pull-down is effected. A target pressure value 80 represents a target value to which the pressure in the evaporative system 6 is changed when effecting the pull-down. Usually an actual pressure 81 changes along the target pressure value 80. When the actual pressure value 81 is deviating from the target pressure value 80, a control duty 83 of the purge valve 4 is controlled so that the actual pressure 81 can change along the target pressure 80. At this time, if the difference dP between the actual pressure 81 and the target pressure 80 is more than a predetermined value (15 mmHg in this embodiment) a predetermined time period t (10 seconds in this embodiment) after the pull-down is started, it is judged that there exists a leakage in the evaporative system. At this time, if a large amount of evaporative gas is produced from the fuel tank, it is possible that the difference between the actual pressure 81 and the target pressure 80 is large, and therefore the leakage diagnosis, including the above diagnosis, is not effected.

Figure 26:
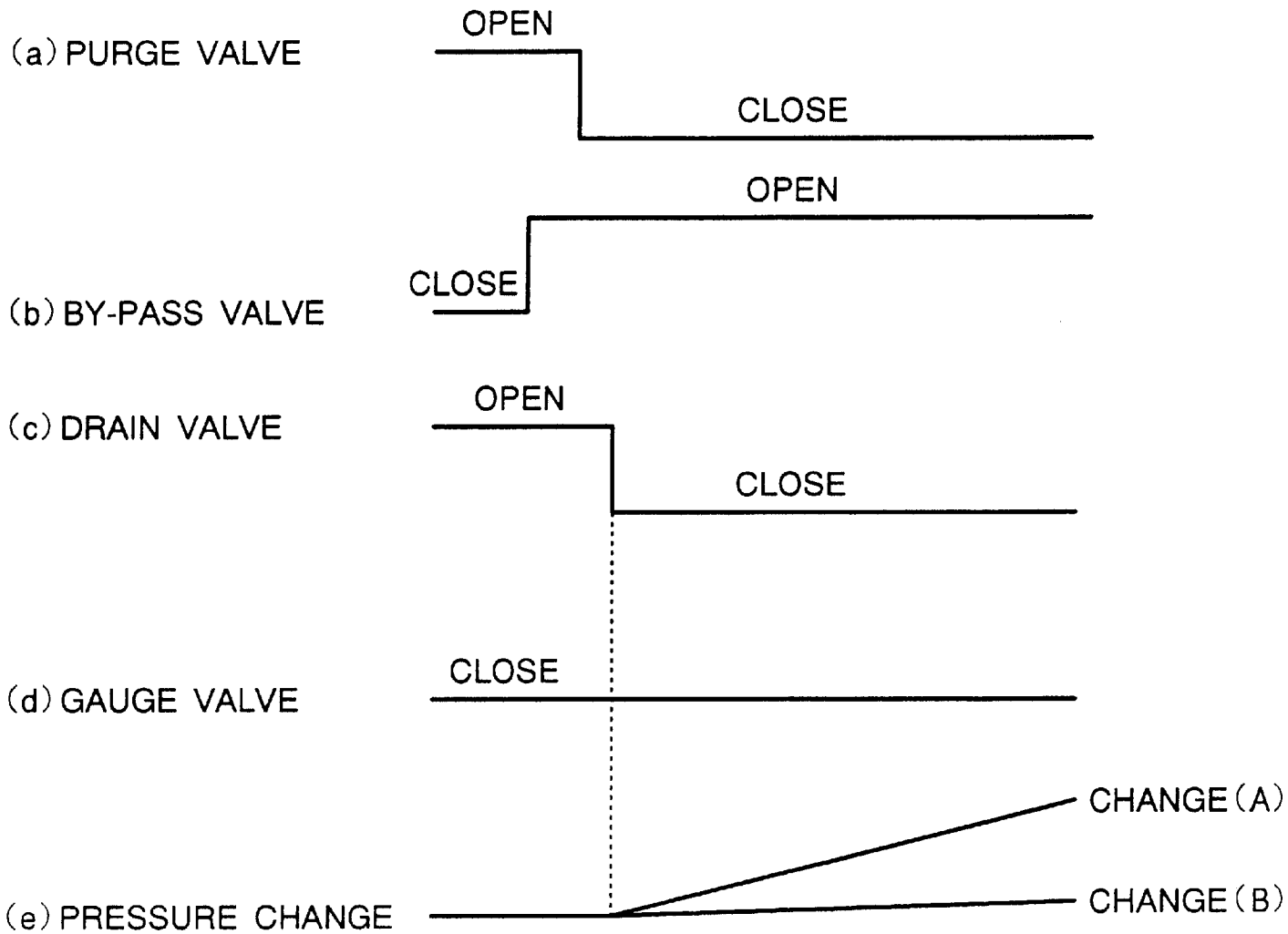
FIG. 26 is a diagram showing a method of estimating the amount of production of evaporative gas.

FIG. 26 shows a method of estimating the amount of production of the evaporative gas from the fuel tank. The purge valve 4, the by-pass valve 15, the drain valve 10 and the gauge valve 17 are opened and closed as indicated respectively in (a), (b), (c) and (d) in FIG. 26. At this time, the evaporative system 6, including the fuel tank 13, becomes a closed system, and therefore if a large amount of evaporative gas is produced, the pressure in the evaporative system 6 increases as at a change (A) in (e) in FIG. 26. If the amount of production of the evaporative gas is small, the pressure increase is small as at a change (B). Therefore, if the pressure increase is large, the leakage diagnosis, including the above diagnosis, is not effected, thereby preventing an erroneous diagnosis.

Figure 27:
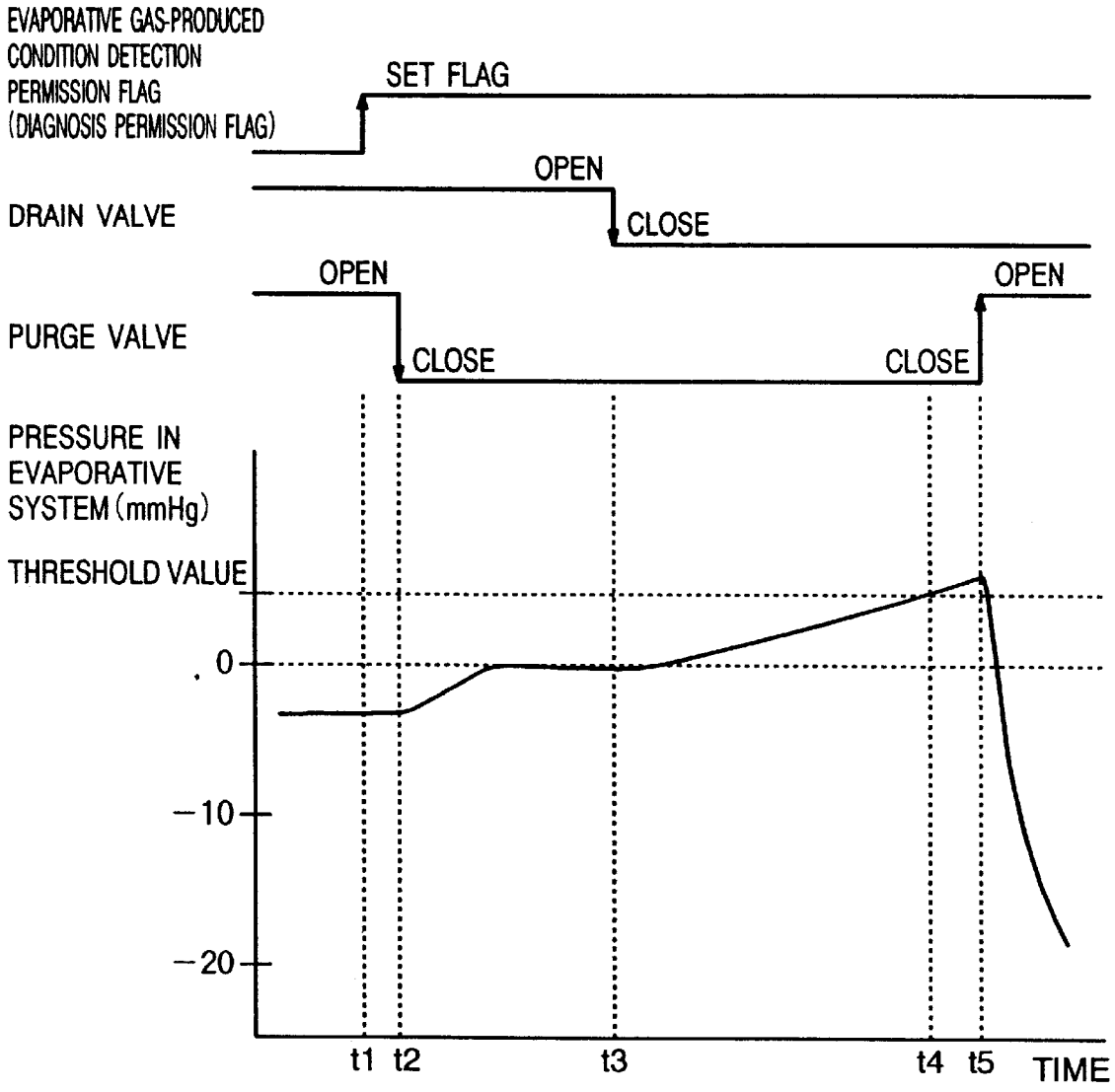
FIG. 27 is a diagram showing a method of estimating the amount of production of evaporative gas.

Next, with reference to FIG. 27, explanation will be made of a method of inhibiting the diagnosis or correcting the diagnosis when the production of a large amount of evaporative gas is detected.

The detection of the condition of production of the evaporative gas (or the execution of the diagnosis of the evaporative system 6) is permitted at time t1, and then the purge valve 4 is closed at time t2. Then, at time t3 after the elapse of such a time period (which varies depending on the kinds of constituent parts of the evaporative system 6, the length of the line (piping), and so on, and is determined by the measured values or the like) that the pressure in the evaporative system reaches a pressure near to the atmospheric pressure, the by-pass valve 15 is opened, and the drain valve 10 is closed, thereby sealing the interior of the evaporative system in a pressure condition near to the atmospheric pressure. In the case where the evaporative system comprises the check valve 16 provided between the canister 8 and the fuel tank 13, and the controllable by-pass valve 15 by-passing the check valve 16, it is necessary to open the by-pass valve 15 during the time period from the permission of the detection of the condition of production of the evaporative gas (or the execution of the diagnosis) to the closing of the drain valve 10 (however, the by-pass valve 15 may be opened after the closing of the drain valve 10 in so far as the detection of the condition of production of the evaporative gas is not adversely affected). Then, during a predetermined time period from time t3 to time t5 (which varies depending on the kinds of constituent parts of the evaporative system 6, the length of the line (piping), and so on, and is determined by the measured values or the like), if the pressure in the evaporative system exceeds a predetermined threshold value x (positive pressure), for example, at time t4 in FIG. 27, it is judged that the amount of production of the evaporative gas is more than the predetermined value. Alternatively, the condition of production of the evaporative gas can be detected by the change amount (change rate) of the pressure in the evaporative system.

When a large amount of evaporative gas is produced, the increase of the internal pressure of the evaporative system due to the partial pressure of the produced evaporative gas acts as a disturbance for the diagnosis of the evaporative system, thereby lowering the diagnosis precision. Therefore, when the condition, in which a large amount of evaporative gas is produced, is detected, the diagnosis is inhibited or interrupted, or the leakage threshold value of the evaporative system diagnosis is so changed as to prevent an erroneous diagnosis (that is, the threshold value is changed to a value larger than the ordinary value). Alternatively, a correction is made so as to reduce the estimated value of the leakage cross-sectional area A1 (the change amount of the internal pressure of the evaporative system may be used as DP3 in the formula (1)), thereby preventing an erroneous diagnosis.

Figure 28:
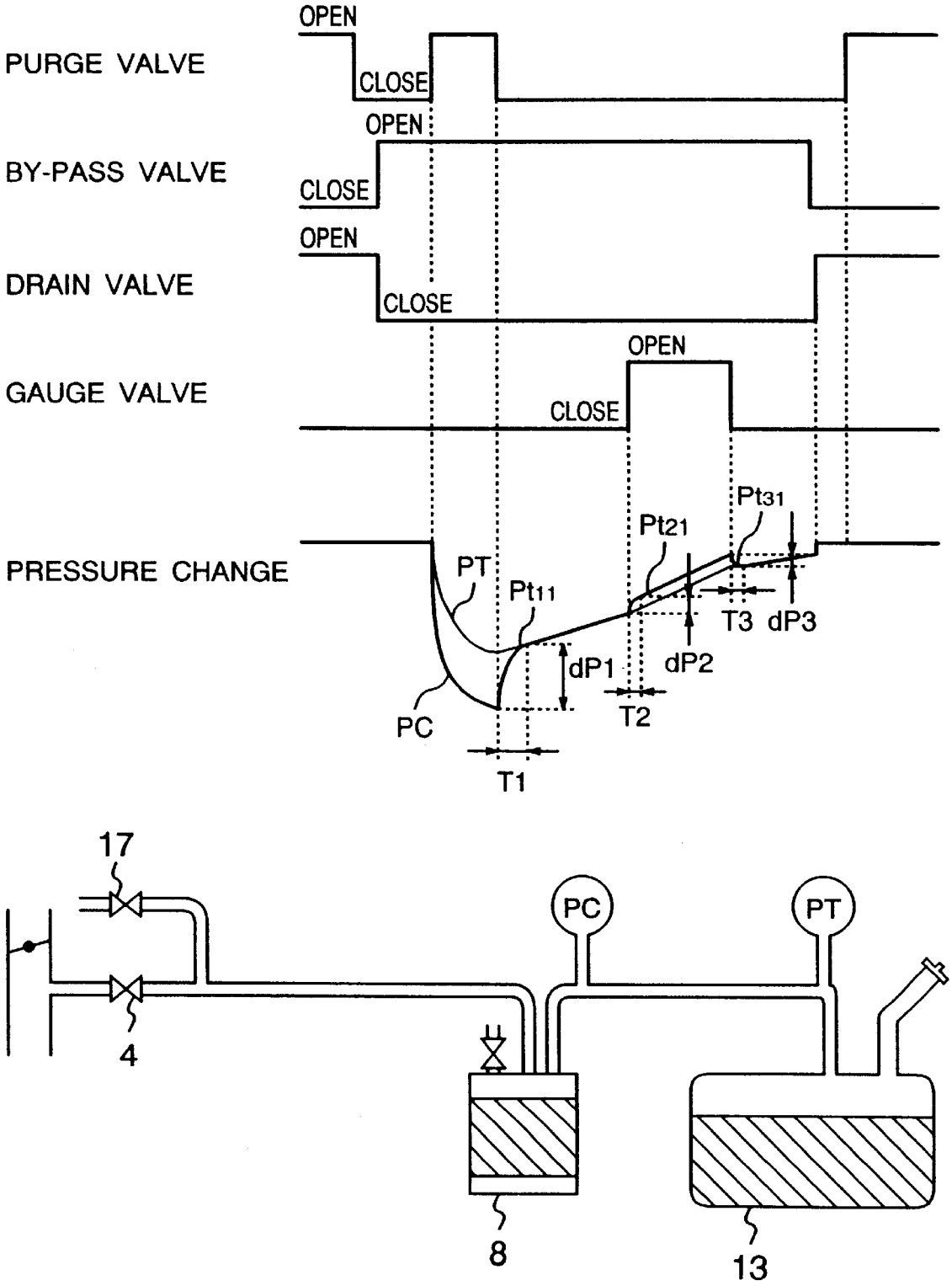
FIG. 28 is an illustration showing a pressure change for explaining timings of measuring the pressure.

Next, the pressure change, occurring when opening and closing the valves, as well as the timings of measuring the pressure, will be described. FIG. 28 shows the pressure change obtained by measuring the pressure at two points (positions) in order to confirm a phenomenon occurring when the valves are opened and closed for the leakage judgment in one embodiment of the invention, and FIG. 28 also show the positions of measurement of the pressure. The pressure PT is measured at a position near to the fuel tank 13, and the pressure PC is measured at a position near to the canister 8, and the length of the evaporative gas line between the two is about 1 m. As will be appreciated from two curves representing the pressure change, there is the difference between the pressure PT and the pressure PC. This difference occurs when there is a flow in the line extending between the two measurement positions. The cause of this is a reduction by the resistance of the line to the flow and the dynamic pressure due to the flow. Therefore, if the leakage judgment is made using the pressure PC, the result deviates from that obtained using the true pressure PT. Such measured pressure deviation can lead to an error in the result of the leakage judgment, and should preferably be removed. To solve this problem, the pressure sensor 11 is provided between the fuel tank 13 and the check valve 16 and also between the fuel tank 13 and the by-pass valve 15, or is provided in the fuel tank 13, as described above, and in order to reduce the pressure loss, the diameter of the line (piping) is increased, and in order to suppress the pressure reduction due to the dynamic pressure, the pressure sensor 11 is provided at a place where a positive flow will not occur. However, because of limitations on the mounting position, the above problem, in many cases, can not be solved by these means. Actually, when the pressure sensor 11 is mounted in a mountable position, and the pressure is measured, behaviors similar to those of the pressure PC are exhibited in many cases. Various tests were conducted, with the measured values of the pressure sensor 11 represented by Pt, and as a result it has been found that for example, the difference between the pressure Pt and the pressure PT during the pull-down is about 5 to 10 mmHg though depending on the degree of opening of the purge valve 4 for the pull-down. The time, required for the pressure Pt to coincide with the pressure PT after the closing of the purge valve 4, is several seconds though it depends on the degree of opening of the purge valve 4 for the pull-down, the remaining fuel amount, and whether or not there is a leakage. The difference between the pressure Pt and the pressure PT during the opening of the gauge valve 17 is several mmHg, and the time, required for the pressure Pt to become stable after the opening of the gauge valve 17, is within about 1 second, and the time, required for the pressure Pt to coincide with the pressure PT after the closing of the gauge valve 17, is within about 1 second. Therefore, the measurement of Pt (measurement of Pt11) after the closing of the purge valve 4 is effected a predetermined time period T1 after the closing of the purge valve 4. The measurement of Pt (measurement of Pt21) after the opening of the gauge valve 17 is effected a predetermined time period T2 after the opening of the gauge valve 17, and the measurement of Pt (measurement of Pt31) after the closing of the gauge valve 17 is effected a predetermined time period T3 after the closing of the gauge valve 17. Preferably, the time period T1 is changed and set to a larger value if the degree of opening of the purge valve 4 for the pull-down is large, and/or the time period T1 is changed and set to a smaller value if the remaining fuel amount is large.

In other embodiment, the measurement of Pt1l after the closing of the purge valve 4 is effected after the pressure changes a predetermined amount dP1 from the pressure obtained at the time of closing the purge valve 4. The measurement of Pt21 after the opening of the gauge valve 17 is effected after the pressure changes a predetermined amount dP2 from the pressure obtained at the time of opening the gauge valve 17. The measurement of Pt31 after the closing of the gauge valve 17 is effected after the pressure changes a predetermined amount dP3 from the pressure obtained at the time of closing the gauge valve 17. Preferably, dP1 is changed and set to a larger value if the degree of opening of the purge valve 4 for the pull-down is large.

The predetermined time periods and the predetermined pressures may be used in combination. For example, basically, the pressure is measured a predetermined time period after the operation of each of the above valves, and the pressure is measured when the pressure changes a predetermined amount even if this predetermined time period does not yet elapse. Alternatively, the predetermined pressure dP1 is used after the closing of the purge valve 4, and the predetermined time period T2 is used after the opening of the gauge valve 17, and the predetermined time period T3 is used after the closing of the gauge valve 17.

Preferably, when the pressure Pt21, Pt22 is to be measured during the opening of the gauge valve 17, a correction is made in view of the difference between the pressure PC and the pressure PT, and then the leakage area A1 is calculated.

In the present invention, for effecting the leakage diagnosis of the evaporative system which has the predetermined pressure sealed therein, and has the communication passage or line communicating with the outside air (ambient atmosphere) through the orifice with a known diameter, a change in the pressure in the evaporative system is detected, and by doing so, the influence of the various disturbance factors (the remaining fuel amount, the fuel temperature, the nature of the fuel, the atmospheric pressure and etc.,) on the leakage diagnosis of the evaporative system can be removed, and therefore the leakage diagnosis of the evaporative system can be carried out accurately. And besides, it is not necessary to provide any detector for detecting the above disturbance factors, and the construction of the system can be less costly, and matching elements can be reduced greatly.

What is claimed is:

1. A method of diagnosing an evaporative system, comprising the steps of:

opening a purge valve, provided on a line connected between said evaporative system and an intake tube, in a closed condition of a drain valve connected to a canister;

subsequently detecting a pressure in said evaporative system;

subsequently closing said purge valve when said detected pressure reaches a predetermined value;

subsequently detecting a pressure in said evaporative system in a closed condition of a gauge valve for generating a standard leak between the evaporative system and ambient air, and detecting the pressure in said evaporative system in an open condition of said gauge valve, so as to detect leakage of the evaporative system;

and performing a diagnosis of said evaporative system based on a differential pressure with respect to ambient air and a pressure change corresponding to said detected pressures at a time of opening said gauge valve and at a time of not opening said gauge valve.

2. A method according to claim 1, in which said gauge valve is opened a predetermined time period after the pressure in said evaporative system in a closed condition of said gauge valve is detected.

3. A method according to claim 1, in which first, the pressure in said evaporative system is detected in the closed condition of said gauge valve, and then the pressure in said evaporative system is detected in the open condition of said gauge valve.

4. A method of diagnosing an evaporative system, comprising the steps of:

opening a purge valve, provided on a line connected between said evaporative system and an intake tube, in a closed condition of a drain valve connected to a canister;

subsequently detecting a pressure in said evaporative system;

subsequently closing said purge valve when said detected pressure reaches a predetermined value;

subsequently detecting a pressure in said evaporative system in a closed condition of a gauge valve for generating a standard leak between the evaporative system and ambient air, and detecting the pressure in said evaporative system in an open condition of said gauge valve, so as to detect leakage of the evaporative system;

and performing a diagnosis of said evaporative system based on a differential pressure with respect to ambient air and a pressure change corresponding to said detected pressures in which, first, the pressure in said evaporative system is detected in the closed condition of said gauge valve, and then the pressure in said evaporative system is detected in the open condition of said gauge valve, the pressure in said evaporative system is pulled down to a predetermined pressure, the pressure in said evaporative system is detected, this operation being performed a plurality of times, and a diagnosis of said evaporative system is effected based on the detected pressure in said evaporative system.

5. A method according to claim 4, in which after the second pull-down is finished, said gauge valve is opened, and the diagnosis of said evaporative system is effected based on the detected pressure in said evaporative system.

6. A method according to claim 4, in which the pressure in said evaporative system is detected a plurality of times, and the diagnosis of said evaporative system is performed based on the detected pressure values obtained in a closed condition and an open condition of said gauge valve.

7. A method of diagnosing an evaporative system, comprising the steps of:

detecting a generating amount of an evaporative gas within said evaporative system;

opening a purge valve, provided on a line connected between said evaporative system and an intake tube, in a closed condition of a drain valve connected to a canister;

subsequently detecting a pressure in said evaporative system;

subsequently closing said purge valve when said detected pressure reaches a predetermined value;

subsequently detecting a pressure in said evaporative system in a closed condition of a gauge valve for generating a standard leak between the evaporative system and an ambient air, and detecting the pressure in said evaporative system in an open condition of said gauge valve so as to detect the leakage of the evaporative system; and performing a diagnosis of said evaporative system based on said detected pressures and said evaporative gas generating amount.

8. A method of diagnosing an evaporative system as recited in claim 7, further comprising the steps of correcting the detected pressures by said evaporative gas generating amount and the step of performing a diagnosis of the evaporative system is made on the basis of the corrected pressures.

9. A method of diagnosing an evaporative system as recited in claim 7, further comprising the steps of determining the leakage of the evaporative system on the basis of the detected pressures, correcting the determined leakage is corrected by said evaporative gas generating amount, and performing a diagnosis of the evaporative system on the basis of the corrected leakage.

10. A method of diagnosing an evaporative system as recited in claim 7, wherein the step of detecting the leakage of the evaporative system is determined on the basis of the detected pressures, the leakage of the evaporative system is judged by comparing the determined leakage with a predetermined threshold, and at least one of the determined leakage and said threshold are corrected by said evaporative gas generating amount.

11. A method of diagnosing an evaporative system, comprising the steps of:

introducing a negative pressure to said evaporative system in a closed condition of said evaporative system;

detecting a pressure in said evaporative system in a closed condition of a valve for generating a standard leakage between the evaporative system and ambient air, and a pressure in said evaporative system in an open condition of said valve; and performing a diagnosis of said evaporative system based a differential pressure with respect to the ambient air and a pressure change corresponding to said detected pressure at a time of opening said valve and at a time of not opening said valve.

12. A method of diagnosing an evaporative system, comprising the steps of:

detecting a generating amount of an evaporative gas within said evaporative system;

introducing a negative pressure to said evaporative system in a closed condition of said evaporative system;

detecting a pressure in said evaporative system in a closed condition of a valve for generating a standard leakage amount between the evaporative system and ambient air, and a pressure in said evaporative system in an open condition of said valve; and performing a diagnosis of said evaporative system based on said detected pressures, wherein a diagnosis of the evaporative system is performed on the basis of the detected pressures and said evaporative gas generating amount.

* * * * *